US008074698B2

(12) United States Patent
Allsopp

(10) Patent No.: US 8,074,698 B2
(45) Date of Patent: Dec. 13, 2011

(54) WINDOW BLIND SYSTEM

(75) Inventor: Reginald Charles Allsopp, Stockport (GB)

(73) Assignee: Louver-Lite Limited, Cheshire (GB)

( * ) Notice: Subject to any disclaimer, the term of this patent is extended or adjusted under 35 U.S.C. 154(b) by 554 days.

(21) Appl. No.: 10/596,824

(22) PCT Filed: Feb. 3, 2006

(86) PCT No.: PCT/GB2006/000372

§ 371 (c)(1),
(2), (4) Date: Mar. 13, 2009

(87) PCT Pub. No.: WO2006/109009

PCT Pub. Date: Oct. 19, 2006

(65) Prior Publication Data

US 2009/0205787 A1 Aug. 20, 2009

(51) Int. Cl.
*E06B 9/26* (2006.01)

(52) U.S. Cl. ..... 160/107; 160/369; 160/381

(58) Field of Classification Search ..... 160/107, 160/98, 104, 381, 84.06, 31, 369
See application file for complete search history.

(56) References Cited

U.S. PATENT DOCUMENTS

| | | | | | |
|---|---|---|---|---|---|
| 808,400 | A | * | 12/1905 | Parsons | 160/28 |
| 1,779,859 | A | * | 10/1930 | Shrauger | 160/381 |
| 2,026,830 | A | * | 1/1936 | Everhard | 160/369 |
| 2,596,438 | A | | 5/1952 | Roillings | |
| 2,636,458 | A | * | 4/1953 | Harris | 210/474 |
| 2,898,991 | A | * | 8/1959 | Kelly et al. | 160/369 |
| 3,058,518 | A | * | 10/1962 | Housman | 160/380 |
| 3,071,827 | A | * | 1/1963 | Van Buren, Jr. | 52/511 |
| 3,170,507 | A | * | 2/1965 | Kleinknecht | 160/369 |
| 4,254,813 | A | * | 3/1981 | Vecchiarelli | 160/19 |
| 4,658,879 | A | * | 4/1987 | Van Klompenburg | 160/271 |
| 5,000,242 | A | | 3/1991 | Coddens | |
| 5,282,504 | A | * | 2/1994 | Anderson et al. | 160/107 |
| 5,479,979 | A | | 1/1996 | Hayashiguchi et al. | |
| 5,547,011 | A | * | 8/1996 | Dotson et al. | 160/381 |
| 6,173,754 | B1 | | 1/2001 | DeBlock | |
| 6,607,020 | B1 | * | 8/2003 | Jensen | 160/84.06 |
| 7,117,918 | B2 | * | 10/2006 | Franssen | 160/84.06 |
| 2001/0030028 | A1 | | 10/2001 | Poppema | |
| 2003/0075281 | A1 | | 4/2003 | Goldenberg et al. | |
| 2004/0069417 | A1 | * | 4/2004 | Sun et al. | 160/107 |
| 2004/0154753 | A1 | | 8/2004 | Tagtow et al. | |
| 2004/0211531 | A1 | | 10/2004 | Dybdahl | |

FOREIGN PATENT DOCUMENTS

CA 2359549 4/2003

(Continued)

*Primary Examiner* — David Purol
(74) *Attorney, Agent, or Firm* — Haugen Law Firm PLLP

(57) ABSTRACT

A window blind frame system is provided comprising a window blind secured to a frame and optionally at least one frame-securing clip for releasably retaining the frame in position relative to the window casing. The frame may comprise at least two angle joints connecting at least three extruded portions to form a substantially rigid structure, wherein a window blind may be attached to the frame and wherein the frame is configured to interact with a frame-securing clip which releasably retains the frame in position relative to a window casing. The components of the window blind frame system may be provided in kit form. Methods of assembly and fitting of the window blind frame system are also provided.

28 Claims, 15 Drawing Sheets

FOREIGN PATENT DOCUMENTS

| | | |
|---|---|---|
| CA | 2542245 | 4/2003 |
| DE | 10126006 | 5/2001 |
| EP | 0942141 | 9/1999 |
| NL | 1023743 | 6/2003 |
| WO | WO93/18270 | 9/1993 |

* cited by examiner

WINDOW BLIND SYSTEM

CROSS-REFERENCE TO RELATED APPLICATIONS

This application is filed under 35 U.S.C. §371 as a National Stage of International Patent Application Ser. No. PCT/GB2006/000372, which claims priority to British patent application Serial No. 0507235.0, which was filed on Apr. 9, 2005 and entitled "WINDOW BLIND SYSTEM", the contents of which are herein incorporated in their entirety.

The invention relates to improvements in window blinds, in particular but not exclusively to improvements in blinds for use in covering windows of the type found in buildings or rooms where there is large window area. For instance, conservatories, industrial and/or commercial buildings which either have large windows or are substantially entirely encased in glass It is common for windows and other apertures to be covered by blinds so that privacy may be maintained and light transfer between the internal and external surroundings reduced. Due to the large expanse of glass found in some environments (including conservatories), the use of blinds becomes particularly important for the maintenance of privacy and to reduce both the light entering the room, and the subsequent heat build up. Accordingly, the ability to reduce the amount of light entering a room helps to prevent the room from becoming uncomfortably warm.

Blinds specifically for use in conservatory environments have been developed, and may be fitted to cover the overhead windows, surrounding vertical windows or both. Rebated conservatory blinds are known; these are blinds which are fitted within the window frame, with a different blind for each pane of glass. This allows the window to be opened when the blinds are fully deployed.

However, the fitting of these known blinds necessitates the screwing of blind components into the window frame itself, causing damage to the conservatory or window frame and leaving unwanted holes in the frame should an error be made during fitting, or should the blind be removed for any reason. In addition, the task of fitting the blinds must be completed on-site by a skilled blind fitter. This will often be inconvenient to the purchaser who (for substantial periods of time) would typically be present to allow the fitter to hang the blinds, and may lead to significant fitting costs which must be born by the purchaser. It is therefore desirable to overcome or ameliorate both of these problems.

In addition, rebated blinds, although offering an improved fitting to the window, often do not hang in close alignment to the window pane, a feature which may be aesthetically undesirable. This is because where the window casing includes angled beading, as is common in modern window and door installations, the headrails of the blinds are often slightly twisted relative to the window pane by virtue of the necessity of fitting the headrail to the angled beading. A further feature of rebated blinds, in common with conventional blinds which cover the window and the surrounding frame, is that the headrail and other components of the blind are fully visible in use; this may also be aesthetically undesirable.

Rebated blinds, unlike conventional blinds, can suffer from light strike (unwanted light entering the room) around the edge of the blind, and a perceived lack of privacy due to the gap between the edge of the blind and the window frame.

It is therefore desirable to provide a blind which may be used to cover windows or other glazed apertures and which offers the advantages of rebated blind systems whilst overcoming the associated problems of blinds of this type.

It is also desirable to provide a window blind frame system which may be fitted to a wide range of different types of aperture, in different settings but which provides an integrated appearance in each application.

Further, it is desirable to provide a blind which is simple to manufacture and may be conveniently assembled from a kit.

According to a first aspect of the invention there is provided a frame-securing clip for anchoring a window blind frame to a window casing comprising a flange for releasable insertion between the window casing and a glass pane within the window casing and a support extending from the flange having at least one engaging member, the engaging member being configured to releasably engage a frame.

According to a second aspect of the invention there is provided a frame-securing clip for anchoring a window blind frame to a window casing comprising a flange for releasable insertion between the window casing and a glass pane within the window casing and a support extending from the flange having at least one engaging member, the engaging member being configured to retain the clip in position relative to a frame; and at least one portion which facilitates the positioning of the frame at a plurality of distances, preferably predetermined discreet distances from the window casing. Preferably the portion is serrated although alternative methods of controlling the positioning of the clip relative to the frame are also envisaged.

According to an additional aspect of the invention, there is provided a frame for a window blind comprising at least two, preferably three, angle joints connecting at least two, preferably three, extruded portions to form a substantially rigid structure, wherein a window blind may be attached to the frame and wherein the frame is configured to interact with a frame-securing clip which releasably retains the frame in position relative to a window casing. Preferably, the frame-securing clip will be the frame-securing clip described in the first aspect of the invention. Such a frame may conveniently be provided in kit form as may other aspects of the invention.

According to a further aspect of the invention there is provided an extruded portion for forming a window blind frame and adapted to interact with a frame-securing clip. Preferably, the frame-securing clip will be the frame-securing clip described in the first aspect of the invention.

According to a further aspect of the invention there is provided a window blind comprising a blind secured to the frame of the earlier embodiment.

According to a further aspect of the invention, there is provided a window blind frame system comprising a window blind secured to a frame and optionally at least one frame-securing clip for releasably retaining the frame in position relative to the window casing. Preferably, the frame-securing clip, frame and blind are as described in the first three aspects of the invention.

According to a further aspect of the invention, there is provided a kit for making a window blind frame system comprising a frame-securing clip for securing a window blind frame to a window casing; at least one extruded portion which may be cut to size according to the dimensions of a window for use in a frame, and at least one angle joint configured to be received by a co-operating channel in an extruded portion. Optionally the kit of this aspect may comprise one or more frame-securing clips as herein described.

According to yet a further aspect of the invention, there is provided a method of assembling a window blind containing a frame comprising the steps of:

a) inserting a first arm of an angle joint into a channel formed in a first extruded portion and securing the arm in position in the channel;

b) inserting a second arm of the angle joint into a channel formed in a second extruded portion and securing the arm in position in the channel;

c) repeating steps a) and b) to until all extruded portions are secured in position relative to the other extruded portions; and d) securing a window blind to a portion of the frame.

According to yet a further aspect of the invention, there is provided a method of fitting a window blind frame system comprising the steps of:

a) ascertaining the dimensions of a pane area of a window;

b) assembling a frame to fit within those dimensions;

c) securing a window blind to the frame;

d) inserting at least one frame-securing clip between the window casing and a glass pane within the window casing; and e) releasably retaining the frame in position relative to the window casing using the frame-securing clip.

In a preferred embodiment, the frame-securing clip is a clip for releasably securing a window blind frame to a window casing, comprising; a flange for releasably inserting between a gasket and a glass pane in the window casing; and a support having a support plane, one or more retaining means which extend out of one side of the support plane for resisting insertion, and preferably removal, of the clip between a pair of projections extending from the blind frame and resisting twisting of the support relative to the projections, and an engaging member which extends out of the other side of the support plane to retain the clip in position relative to the blind frame. In some embodiments the engaging member will be resilient although this is not essential. It is a preferred feature of the invention that the engaging member releasably engages the blind frame.

Alternatively, there is provided in a further preferred embodiment a frame-securing clip for releasably securing a window blind frame to a window casing, comprising; a flange for releasably inserting between a gasket and a glass pane in the window casing; and a support having a support plane, one or more retaining means which extend out of the support plane for resisting twisting of the support relative to the projections and aiding retention of the clip relative to an extruded portion of the frame, and an engaging member which facilitates the positioning of the frame at a plurality of distances from the window casing, the engaging member extends out of the support plane to retain the clip in position relative to the blind frame and in preferred aspects of the invention is serrated.

Preferably, also in a preferred embodiment, the frame-securing clip for anchoring the window blind frame to the window casing comprises a flange for insertion between the window casing and a glass pane within the window casing, and a support having at least one engaging member extending from the flange, wherein insertion of the flange provides for retention of the frame-securing clip in a position relative to the glass pane. In one embodiment the engaging member is configured to interact directly with the frame, thereby releasably retaining the frame in position relative to the window casing. In an alternative embodiment, the engaging member is configured to interact with a positioning guide, allowing releasable retention of the clip in position relative to the positioning guide preferably at predetermined discreet spacings, the positioning guide being adapted for retention within an extruded portion of the frame through the inclusion of securing means included (preferably integrally) on the positioning guide.

The term 'window casing' is used herein to mean the part of the window which holds the glass pane in position within the window and includes the frame and any beading, gasket or other means for securing the glass pane in position for use.

The terms 'glass' and 'glass pane' as used herein are intended to encompass any transparent or translucent covering for a door or window aperture. For instance, plastics panels, such as polycarbonate panels, will also fall within the scope of these terms unless otherwise specified.

In one embodiment the engaging member of the frame-securing clip is configured to interact with an extruded portion of the frame; in this embodiment it is preferred that the engaging member be a resilient lug protruding from the support and in a direction generally orthogonal to the plane of the support, however, the engaging member could also be a hook, one part of a screw-fit connection, one part of a snap fit connection or other known engaging means. Where the engaging member is a resilient lug, the necessity of affixing additional components such as screws to the frame-securing clip in order to secure the frame to the frame-securing clip is removed. This provides for quick and easy installation of the frame.

Where the engaging member is a resilient lug, preferably the lug extends out from the support in a direction away from the direction of projection of the flange; preferably it extends in a direction 180° to the direction of projection of the flange. Most preferably, the resilient lug extends from the support and comprises a lug protruding from a resiliently deformable stem. The resiliency of the lug allows the lug to be temporarily deformed inwards, in the direction of the projection of the flange, when the frame is fitted to the window.

In an alternative embodiment, the engaging member may be a serrated region on the support, however this is not essential providing that the engaging member includes one or more features which facilitate the controlled positioning of the frame at a plurality of distances from the window casing. Where the engaging member is serrated, it is preferred that the serrated region engages a positioning guide, the positioning guide being adapted to be retained in and engage with the frame. It is also preferred that the positioning guide include co-operating serrations allowing releasable retention of the clip in a predetermined but changeable position relative to the positioning guide. Accordingly, each serration on the engaging member may co-operate with and be retained between any of two co-operating serrations on the positioning guide thereby making a multiplicity of relative positions between the clip and the positioning guide available. The positioning guide is then typically retained in a fixed position relative to the frame, and where this is the case the presence of serrated members on both the positioning guide and the engaging member allows precise positioning of the frame relative to a window.

The serrations are typically a series of co-operating recessed and peaked regions in the positioning guide and clip. Preferably these will be elongate, however, they may adopt a range of conformations including a simple 'chequerboard' pattern. The depth of the serrations on the positioning guide and clip will be sized to allow co-operation between these features. Typically to provide a strong hold the depth of a serration (i.e. the distance that the serration protrudes from the plane of the clip or positioning guide) must be 0.5 mm or greater, more preferably in the range 0.5 mm to 3 mm, most preferably in the range 0.5 mm to 1.5 mm.

The presence of the serrations on each of the clip and positioning guide or other means of finely adjusting the distance between the clip and the frame, offers the advantage that it the blind fitter may produce a 'standardised' close fitting window blind frame system, which is aesthetically pleasing and appears to the user to fit closely to the window casing despite the presence of unevenness or irregularity in the casing itself. This may arise, for instance where the original assembly of the window was poorly executed resulting in a frame with different depths from the pane to the edge of the frame distal from this on different sides of the pane. Further, it facilitates the use of the window blind frame system with windows of differing construction and frame depth, without the need for the blind manufacturer to make and store the wide range of clips of slightly differing dimensions as would otherwise be necessary.

There may be a plurality of serrated regions on the support. Alternatively, there may be a single serrated region which may occupy a small localised region of the support, may cover substantially the entire face of the support, or any degree of covering in between. Preferably, there will be two distinct serrated regions, one each appearing towards an edge of the support. Most preferably, the edges will be the opposing sides of the support, neither of which is connected to the flange.

Typically, the serrations will be formed by cutting flaps in the support and pushing the flaps out of the plane of the support. Where this is the case, it is highly preferred that the flaps are pushed into out of this plane in a direction opposite to that of the retaining members. However, it is also possible that the serrations will be integrally moulded as part of the clip, sculpted from the clip after moulding, or affixed to the clip as a separate component.

It is preferred that the positioning guide is substantially rectangular for ease of manufacture although other shapes could also be used. Typically, one face of the positioning guide is substantially entirely covered with serrations, this allows for the positioning guide and clip to be positioned relative to one another in a broader range of positions than would otherwise be possible. In addition, providing an expanse of serrations on the positioning guide which is relatively large allows a range of clips of different sizes to be used with a positioning guide of just one design, thereby reducing the number of stock components which must be kept by the blind fitter. However, although it is preferred that most of one face of the positioning guide is serrated, it is also envisaged that there may be defined regions of serrations, specifically located to interact with the serrated regions of the clip.

Typically, the positioning guide will be releasably engagable with an extruded portion of the frame. This is achieved through the presence of securing means which will typically (as with the engaging member of the non-serrated clip above) be a resilient lug protruding from the positioning guide and in a direction generally orthogonal to the plane of the positioning guide, however, the engaging member could also be a hook, one part of a screw-fit connection, one part of a snap fit connection or other known securing means. Where the securing means is a resilient lug, the necessity of affixing additional components such as screws to the frame-securing clip or to the positioning guide in order to secure the frame to the positioning guide is removed. This provides for quick and easy installation of the frame.

In preferred embodiments the positioning guide and clip combination is sized such that there is a friction fit between these components and the extrusion. More specifically it is preferred that the positioning guide and clip are in friction fit with two adjacent projections extending from the rear of the extrusion as this component is positioned in the frame for use. This (preferably in combination with the securing means of the positioning guide) retains the clip and positioning guide in position relative to the frame. However, the skilled person would readily understand that a wide range of alternative or additional features may be used to achieve secure retention of the positioning guide and clip relative to the frame.

Preferably, there is a raised edge along at least one side of the positioning guide, typically there will be a raised edge around three sides of the positioning guide. The presence of this feature defines the area of the positioning guide in which the clip can move and, where the serrations are elongate, prevents the positioning guide and clip becoming disengaged through relative movement in the direction normal to the serrations. Such movement could cause the frame to become disengaged from the clip and to loosen from or fall out of the aperture.

In addition, the raised edge provides 'depth' to the clip which, in some embodiments, helps to facilitate retention of the clip and positioning guide in position relative to the frame. In such embodiments a friction fit is created between the positioning guide and clip combination and adjacent projections from the extruded portion of the frame. Typically the raised edge will have an external height (i.e. the total depth of the positioning guide at a point where the raised edge is present) in the range 2 mm-5 mm, more preferably 3 mm-4 mm.

It is generally preferred that the positioning guide be made of a moulded plastics material, however it may also be made of metal. Where the positioning guide is made from moulded plastics, typically the serrations will be integrally moulded with the body of the positioning guide. However, other methods of forming the serrations are also considered, for instance, sculpting of the clip after moulding, affixing the serrations to the clip after this component has been moulded or, particularly where the positioning guide is of metallic construction, cutting flaps from the metal and creating serrations by pushing these out of the plane of body of the positioning guide.

It is preferred that, where the securing means is a resilient lug, that the lug extends inwards from a raised edge of the positioning guide and substantially parallel to the plane of the positioning guide including the serrations. It is preferred that an area of the positioning guide which would lie adjacent to the securing means is cut away from the positioning guide so that the resilient lug may deform into, and away from, the plane of the positioning guide, as necessary.

Most preferably, the securing means comprises a resiliently deformable stem which may comprise at the end distal to the raised edge of the positioning guide, a lug protruding from the stems. The resiliency of the stem allows the lug to be temporarily deformed inwards (preferably into the plane of the positioning guide), when the frame is fitted to the window. This allows the resilient lug of the positioning guide to engage the blind frame, retaining the positioning guide therein in a manner similar to the retention of the resilient lug of the clip in the embodiment where the engaging member is a resilient lug.

It is preferred in this embodiment that the clip comprises a recess in which the securing means of the positioning guide is positioned when the clip and the positioning guide are interengaged. Providing the movement of the securing means is not hindered by the clip, this recess may have any shape. Preferably, however, it will be a simple rectangular or 'U' shaped cut-out.

Typically, the recess will be in the middle of the edge of the support farthest from the flange and it is preferred that, where there are two retaining means, the retaining means appear one on either side of the recess. It is further preferred that there are two engaging means and that these are located on the outside edges of the support with the retaining means positioned between these and the recess. In order to interact with a clip of this configuration it is preferred that the securing means of the positioning guide extends substantially from the middle of a raised edge of the positioning guide and that the area either side of the securing means is serrated.

It is a preferred feature that the overall direction of extension of the support in the clips of the invention is substantially orthogonal from the flange. Preferably, the general direction of extension of the support defines the support plane. Preferably, the frame-securing clips are generally L-shaped with the flange and the support forming the two limbs of the "L". This configuration provides for the greatest interaction of the flange with the window casing, whilst allowing interaction of the engaging member with the frame. In a particularly preferred embodiment, the support includes a corrugated section allowing the support to project slightly away from orthogonal and over the flange. This configuration allows the flange to securely fit between the window casing and the glass pane, without damaging any resiliently deformable gasket which is typically found between the glass pane and beading securing the glass within the window casing. It is important that the resiliently deformable gasket is not damaged, as damage to this component could allow water to pass between the beading and the glass pane, causing the window to leak.

In the embodiment where the engaging member on the frame-securing clip engages directly with the frame, it is preferred that it engages with a co-operating slot in an extruded portion of the frame. In the embodiment where the clip is retained in position relative to the frame via the positioning guide, it is preferred that it is the securing means of the positioning guide that engage with a co-operating slot in an extruded portion of the frame. More preferably, the engaging member and/or securing means are retained in the co-operating slot by the presence of retaining means which may act against parts of the frame and resist movement of the clip (and positioning guide as appropriate) in a direction relative to the frame which would be necessary to disengage the engaging member and/or securing means (e.g. a resilient lug) from the co-operating slot. The retaining means may be a second part of a screw or snap fit connection co-operating with the engaging member or securing means. However, preferably the retaining means comprises at least one prong, in particular an arcuate prong, extending from the support of the clip whether the clip is the clip of embodiments where the engaging member directly interacts with the frame, or whether the clip is the clip described in embodiments where the engaging member interacts with a positioning guide. As noted above, the use of screw or snap fit connections to fasten the frame-securing clip (and positioning guide in some embodiments) to the frame requires the addition of further components to hold the frame in position relative to the frame-securing clip. This increases the skill and time involved in fitting the frame, and is therefore less desirable.

It is preferable that the co-operating slots are formed in the extruded portion of the frame in a separate step subsequent to extrusion. The extruded portion is typically, although not exclusively, sold without the slots. The slots are created using a cutting jig or similar tool prior to assembly of the frame. This allows the co-operating slots to be placed in the optimum position for holding the frame securely relative to the window casing.

It is advantageous in the embodiment where the engaging member interacts directly with the frame for the arcuate prong to extend from the support of the clip so that the outer surface of the arc projects over the flange and away generally from the resilient lug. Conveniently, the retaining means (e.g. arcuate prong) and engaging member (e.g. resilient lug) project in opposite directions on opposite sides of the support plane. This provides for insertion of the resilient lug into the co-operating slot by snap-fit interaction facilitated by urging the arcuate prong past a projection of the extruded portion of the frame, thereby allowing the resilient lug to enter the co-operating slot. Typically, although not exclusively, there may be two arcuate prongs on each frame-securing clip. It is preferred that the arcuate prongs are substantially on opposite edges of the support, thereby providing additional stability to the interaction between the frame-securing clip and the frame.

However, in the embodiment where the engaging member engages with the positioning guide, it is preferred that the retaining means (e.g. the arcuate prong or prongs) extends from the support of the clip so that the outer surface of the arc projects away from the flange. When positioned for use, this configuration pushes the clip away from a projection in the extruded portion with which the clip and positioning guide are engaged, towards the positioning guide. This results in the positioning guide and clip being pushed together. Accordingly, a secure interaction between the positioning guide and the portion of the clip which facilitates the positioning of the frame at a plurality of distances from the window can be achieved.

In preferred embodiments the clip may include spacers. One situation where these may be appropriate for inclusion is where the clip is intended for use in conservatory roofing applications. The spacer may have one or more functions dependent upon the design of the clip and intended use. For instance, the spacer may function to protect the seal between the glass and the frame of modem UPVC or aluminium window and door casings. Where this is the case, the spacer will function to prevent the flange of the clip from being pushed beyond a predetermined distance between the glass and the gasket which is typically present between the glass and frame of modem window and door frames. Thus damage to the seal between the gasket and glass pane is avoided.

Additionally or alternatively, the spacer may act as a shelf against which the extrusions of the inventive frame may rest. This creates distance between the inventive frame and the window casing allowing, where necessary, the frame to be placed (by selective positioning of the clip and positioning guide) in a different position relative to the window casing for each clip around the window blind frame without this difference in position being apparent to the user. As a result, any defect in the accuracy of the construction of the window casing itself, for instance any difference in the depth of the casing between the glass and casing edge, can be hidden by the blind frame of the invention without distortion to the frame.

For ease of manufacture, preferably the frame-securing clip is of one-piece construction, and made of resilient material. More preferably, the frame-securing clip is metallic. The frame-securing clips used in the inventive window blind frame system may all be identical, or of differing designs. Specifically, if advantageous, a combination of clips designed to engage directly with the frame and clips designed to engage with a positioning guide which then engages with the frame may be used.

The frame of the invention may conveniently be used with both overhead windows and vertical windows. These may be in any of a variety of shapes including triangular, rectangular and rhomboid. It will be understood that the term rectangular includes square windows.

Where the window to be covered is triangular, there will preferably be three extruded portions and three angle joints. It is advantageous that the three extruded portions and the three angle joints are configured to form a substantially closed triangular configuration which corresponds to the shape of the window casing with which it will be used. The angle joints used in triangular configurations may be flexible angle elbow joints which may be used and fixed at angles conveniently in the range 10° to 170°, or they may be rigid angle joints suitable for use only in specific angles. For instance, the rigid angle joint may conveniently be fixed at an angle selected from 10°, 15°, 20°, 25°, 30°, 35°, 40°, 45°, 50°, 55°, 60°, 65°, 70°, 75°, 80°, 85°, 90°, 95°, 100°, 105°, 110°, 115°, 120°, 125°, 130°, 135°, 140°, 145°, 150°, 155°, 160°, 165° or 170°. A combination of flexible and rigid angle joints may be used if required, alternatively, all of the angle joints may be either rigid or flexible, thereby ensuring that the assembled frame forms a triangle that will fit accurately into the window casing to be covered.

Where the frame of the invention is intended for use with a square, rectangular or a rhomboid window, there will preferably be four extruded portions and four angle joints. It is advantageous that the four extruded portions and the four angle joints are configured to form a substantially closed configuration which corresponds to the shape of the window casing with which it will be used. Preferably, the angle joints used in rectangular, or square configurations are at substantially 90° thereby ensuring that the assembled frame forms a regular square or rectangle that will fit accurately into the window casing to be covered. However, it will be appreciated that for rhomboid windows the angle joints may be flexible, or rigid and of an angle other than 90° as described above with regard to frames for covering triangular apertures.

A corresponding number of suitable extruded portions and angle joints may be used as are required for other shapes of window.

Angle joints are known in the art and will not be described in detail here. However, it is preferred that the angle joints used in the invention comprise two arms and a body wherein each arm is configured to be received by a reciprocating channel in an extruded portion of the frame. In addition, it is preferred that the angle joints additionally comprise a stabilising extension projecting from the body of the angle joint towards a rear face of the frame when assembled. The presence of this stabilising extension enhances the stability of the assembled frame structure.

The extruded portion of the frame preferably comprises an aesthetically pleasing front face which provides the frame with an integrated appearance when fitted. Extending from the rear of this face of the extruded portion are preferably one or more projections configured to provide surfaces for interaction with the arms of the angle joints and frame-securing clips and/or positioning guides. Where present these projections facilitate the assembly of the frame, and interaction of the frame with the frame-securing clips and/or positioning guides. In a preferred embodiment there are three projections, two forming a channel for interaction with an arm of the angle joint and a further projection including, in use, co-operating slots for interaction with the frame-securing clip. It is preferable that the extruded portions of the frame are straight.

It is preferable that the angle joints are hidden during use by a cover, thereby completing the aesthetically pleasing integrated appearance of the frame. It is therefore preferred that the cover is shaped and coloured to co-ordinate with the front face of the extruded portion of the frame and to hide the angle joint from view. Accordingly, the cover may be made from a range of materials, as will be clear to the reader skilled in the art, however, preferably the cover will be made from a plastics or a die cast material.

Conveniently in some embodiments the ends of the frame may be mitred at the correct angle to provide a symmetrical joint at the angle joint.

The method of assembling the frame may preferably comprise the step of creating co-operating slots in the extruded portions of the frame. Typically, this will be the first step of assembly. The method of assembling the frame may also preferably further comprise the step of hiding some or all of the angle joints with an appropriate cover.

Where the components are sold as a kit, the kit may additionally comprise a cover for hiding an angle joint during use. Preferably, a kit for each blind will typically comprise either three or four covers as appropriate for the shape of the window to be covered by the assembled window blind frame system.

The kit may also additionally comprise one or more positioning guides for allowing the controlled positioning of the frame relative to the window casing. This is particularly desirable where the construction of the window may be such that the depth of the frame may not be equal around all sides of the window. This is sometimes the case with conservatory windows.

It is also possible that the kit would be sold in a form additionally comprising the components for preparing a blind suitable for use with a frame made from the kit. The necessary components would be well known to the person skilled in the art. However, as the kit will often be available to blind fitters who keep a stock of blind components, it is not essential that these be sold with the kit described above. In addition, the kit may also comprise means for securing a blind to a frame made from the kit.

Further, where the components are purchased in bulk they may be sold together, or separately. By 'bulk' it is meant that the components are sold in large numbers or, in the case an extrusion from which the extruded portions are produced, units of multiple metres. For instance, the frame-securing clips, angle joints and covers may conveniently be sold in numbers of 50 or more units, preferably in numbers of 100 or more units. The extruded portions will conveniently be sold in units of 50 meters, 100 meters or more. This offers the benefit that a commercial client, assembling and fitting a large number of blinds, may purchase additional components individually where these components are utilised at a greater rate than others of the components present in the kit. For instance, for covering large windows, more frame-securing clips may be used than where the window to be covered is smaller. As a result, a deficiency may arise in the stock of frame-securing clips, requiring the purchase of additional frame-securing clips. This could occur before, for instance, the angle joints are depleted because only a fixed number of angle joints are used regardless of window size. This situation could also arise where a longer length of extrusion is used to prepare a frame for use with a large window, than would be used for a smaller window, thus depleting the stock of extrusion relative to the stock of angle joints in a kit.

In one embodiment, the blind may be of a design which includes a tension cord, the tension cord being capable of resisting displacement of a sliding rail. Thus, once the sliding rail is disposed in the desired position, the tension cord resists any subsequent unwanted movement of the sliding rail, e.g. from the action of gravity or air movement. The tension cord is preferably arranged in a figure of eight configuration wherein the free ends of the cord are joined via a tension spring. This type of arrangement has been used for conventional fabric blinds, and would be known to the person skilled in the art. Preferably, the tension spring is hidden from view by positioning of the cord behind the frame as mounted for use.

It is preferred that the blind additionally comprises a handle to allow the blind to be moved between an open and a deployed position within the frame without necessitating direct manipulation of the blind fabric. The presence of the handle thereby reduces wear and damage to the blind fabric, and helps to extend the lifetime of the blind. It is advantageous that the handle is at the moving edge of the blind as positioned for use, so that the handle is easily accessible to the user. It is also advantageous that the handle is shaped to allow complete closure of the blind when secured to the frame. This ensures that light strike is minimised, and that the maximum privacy may be obtained. If the handle includes an aperture this will aid the user in gripping the handle, or facilitate the use of a tool to alter the position of the blind within the frame. For instance, where the blind is fitted to an overhead window, or one which is generally difficult to reach, a rod with a hook could be used to engage the handle, and manipulate the blind.

It is generally preferred that the frame is retained in close contact with the window casing to provide an integrated appearance. The retention of the frame in close contact with the window casing also allows the system to be mounted in a window casing which is typically at an angle of between ±90° relative to vertical. Accordingly, the window frame system may be used to cover overhead windows or vertical windows as required. If close contact between the frame and the window is not achieved, the blind within in the frame would have a less pleasing appearance to the user as the components of the blind would be partially visible in use.

However, where a window casing has been inaccurately assembled, so that for instance the depth of the window casing is not consistent around each edge of the glass, it may be preferable to retain the frame at a small distance from the window casing so that the unevenness in the window casing is hidden by the frame. This would not be visible to the user. Where this is the case a clip which may be retained at one of a range of different depths relative to the extruded portions of the frame may be used, the clip may, in some embodiments include a spacer which acts as a shelf to support the extruded portions of the frame. Where the spacer is present and configured to perform this function it can act either to push the frame away from the glass (holding the frame at a one of many possible distances from the glass pane), or to retain the extruded portion in position relative to the clip, preventing the extrusion from falling away from the clip as would be possible where the frame is used with overhead windows. Where this is the case, the spacer would typically comprise a stem or other projection from the clip which is configured so that it can hook under and support part of an extrusion.

Preferably, at least two frame-securing clips are used to ensure secure fitting of the system to the window casing. In four sided window fittings, preferably there is at least one frame-securing clip engaging directly or via a positioning guide with each of two opposite extruded portions of the frame. Optionally there may be two frame-securing clips interacting with each of two opposite extruded portions of the frame. For triangular window fittings, preferably there is at least one, optionally two, frame-securing clips interacting with each of the two longer extruded portions of the frame. This is so that the points of connection between the frame and the window casing are widely distributed. Optionally, the required number of frame-securing clips may be distributed around each edge of the window casing for interaction with each extruded portion of the frame.

It is preferable that the frame-securing clips interact with the 'sides' of the frame as positioned in use. The sides of the frame are formed by the extruded portions adjacent to the extruded portion behind which the head rail of the blind is housed. Positioning the frame-securing clips in this way facilitates removal of the frame because where the frame-securing clips are positioned relative to the 'top' and 'bottom' of the frame (in cases where the window aperture is four sided), it is necessary to place clips for interaction with the extruded portion which supports the blind. This necessitates release of the blind from the frame, so that access may be gained to the frame-securing clips, before the frame itself can be released from the window casing. Similarly, in triangular frames, it is desirable that the clips be positioned for interaction with the extruded portions which do not support the blind, so that the blind need not be released prior to release of the frame from the window casing.

The method of fitting the blind does not require screw fixing of the blind to the window frame as is typical in the prior art methods. This has the major advantage that the risk of damage to the window frame is greatly reduced, and that should errors occur during fitting, or should the user wish to remove the blind, no unsightly holes are left in the window casing. In addition, the creation of holes in the window frame may, in some instances, invalidate the guarantee of the conservatory or other glazed aperture into which the blinds are being fitted. Further, installation is quicker and simpler to use than the method required to fit prior art blinds. The blinds can also be re-used in different similar shaped windows.

If the frame is found to interact with the existing window frame handle, impeding movement of the handle, the method of fitting may include the additional step of introducing packing below the window frame handle, in a manner known in the art, to lift the handle away from the window blind frame system of the invention.

Typically, although not exclusively, the blinds used in the frame system will be pleated or Venetian blinds. Although frame systems including other blind types, for instance roller blinds or woven wood blinds are also envisaged.

It is preferred that the fixed components of the are housed entirely within the frame to maximise the aesthetically pleasing effect of the frame system. The term 'housed entirely within the frame' should be construed as meaning that the blind is fitted into the frame so that the blind head rail is not visible during use, and so that when the blind is deployed, the side edges of the blind are preferably hidden from view by the edges of the frame. When the blind is fully deployed, it is also preferred that the moving edge of the blind extends beyond the edge of the frame of the blind. However, where present, the handle will always be visible. Additional advantages of this feature are the minimisation of light strike, and the provision of total privacy should this be desired.

The blind may be releasably secured to the frame using any securing means common in the art as will be immediately apparent to the skilled person. However, preferably, either spring clips or screws will be used. Where the blind is secured to the frame using a screw, it is preferred to position a rail fixing clip formed from a resiliently deformable material between the frame and the head rail of the blind. This prevents damage to both the frame and blind which could otherwise arise through the abrasive wear caused by small movements of the blind head rail relative to the frame.

Preferably, there will be two securing means, most preferably the securing means will be positioned so that they are secured to, or engage the blind through, one or more co-operating slots in the extruded portion of the frame, to which the blind is secured.

The arms and/or cover may be secured in position by any known securing method. Typically, the arms will be secured in position using screw fixings, although adhesive bonding may also be used.

An embodiment of the invention will now be described in detail by way of example only, with reference to the accompanying drawings in which.

Figure 3:
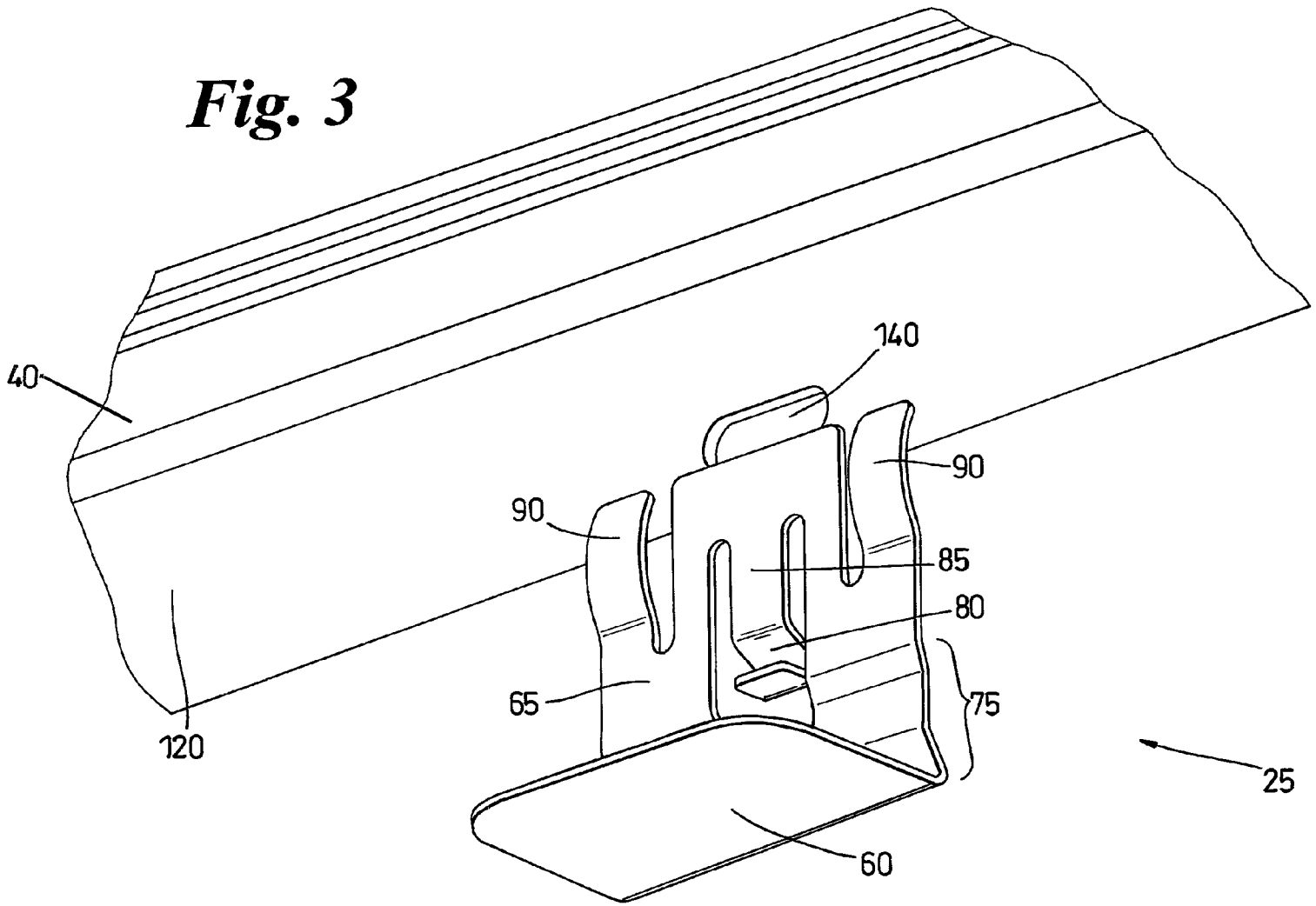
FIG. 3 is a perspective view of a frame-securing clip of the first embodiment of the invention, and an extruded portion of the frame of the second embodiment of the invention.
Figure 4A:
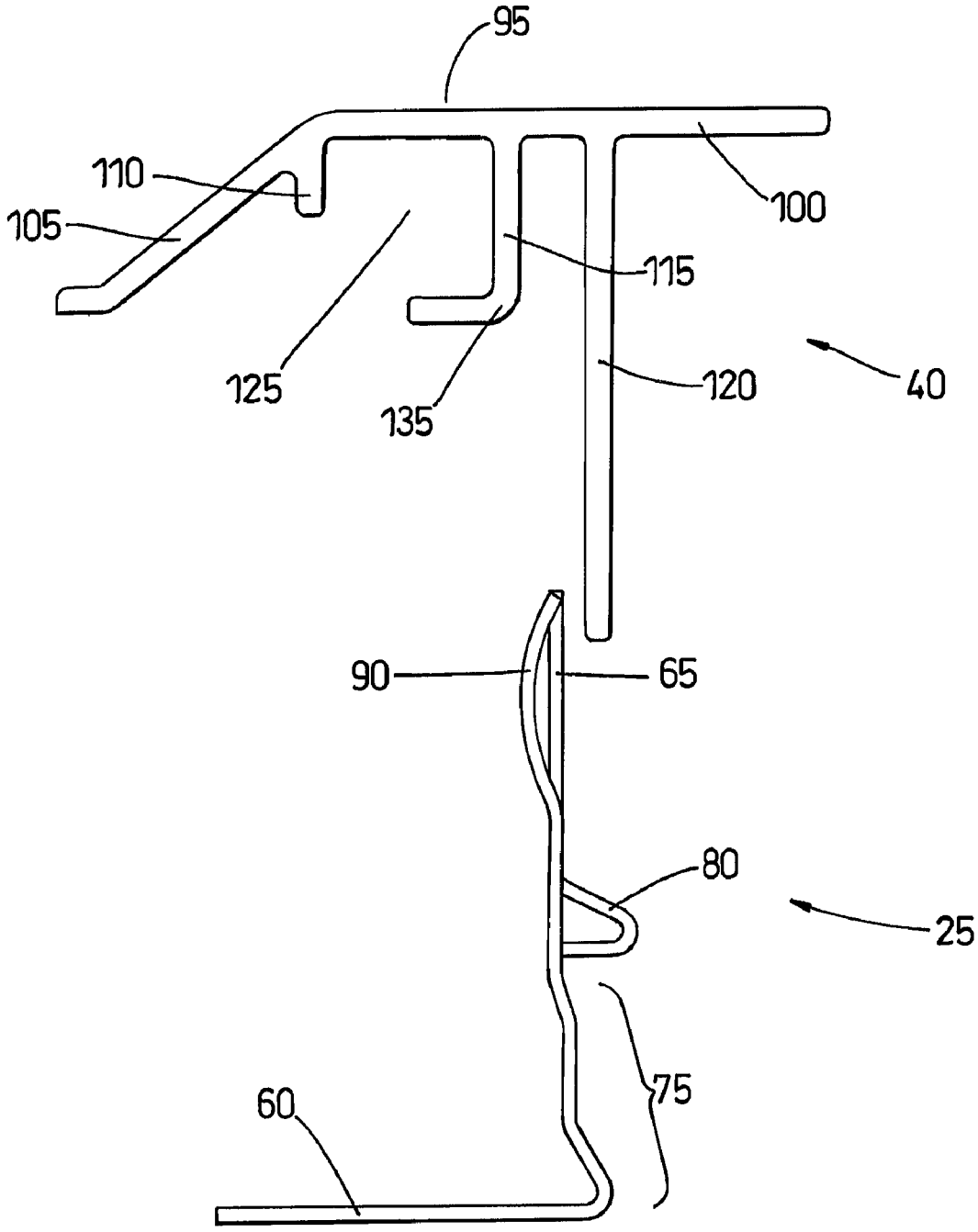
Figure 4B:
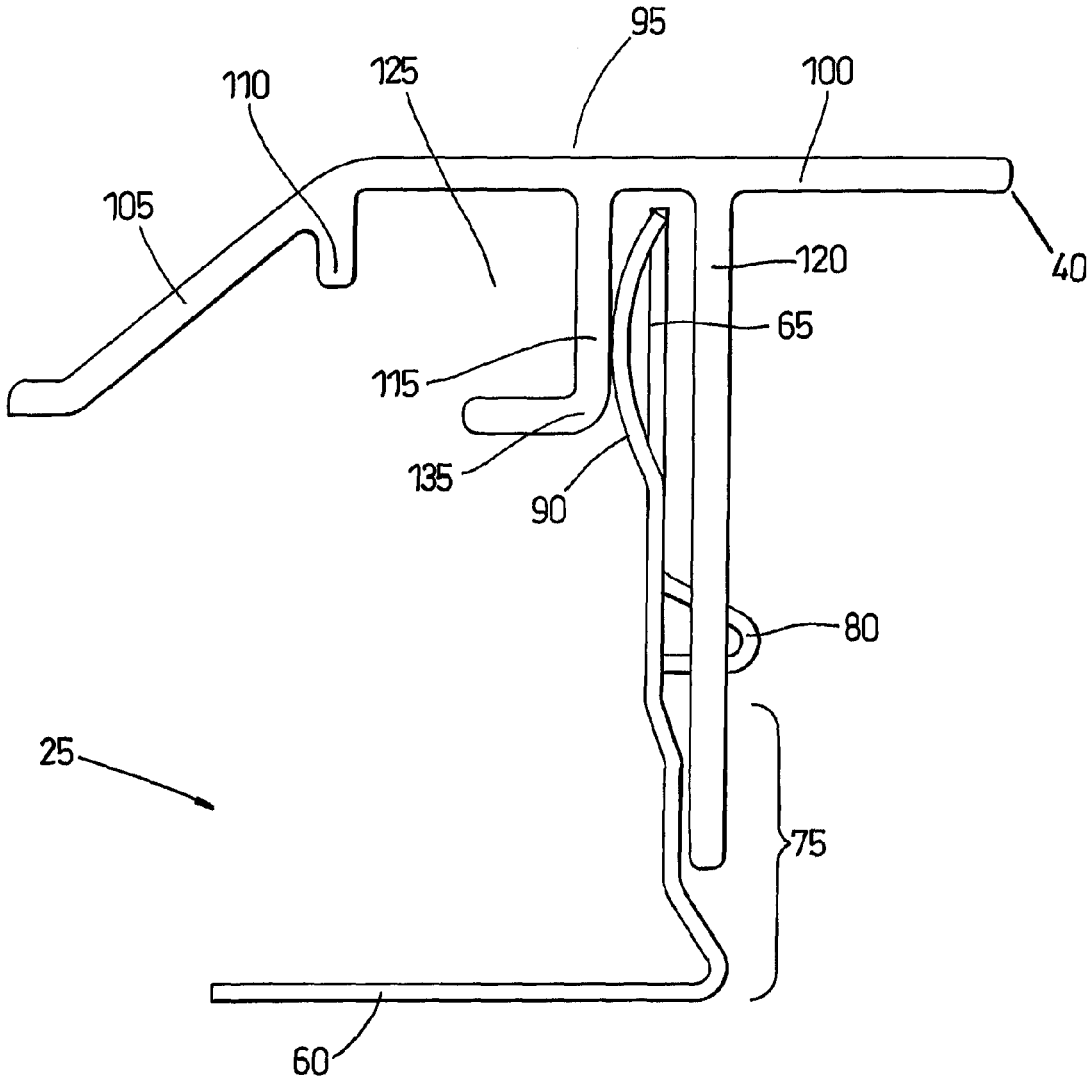
Figure 5A:
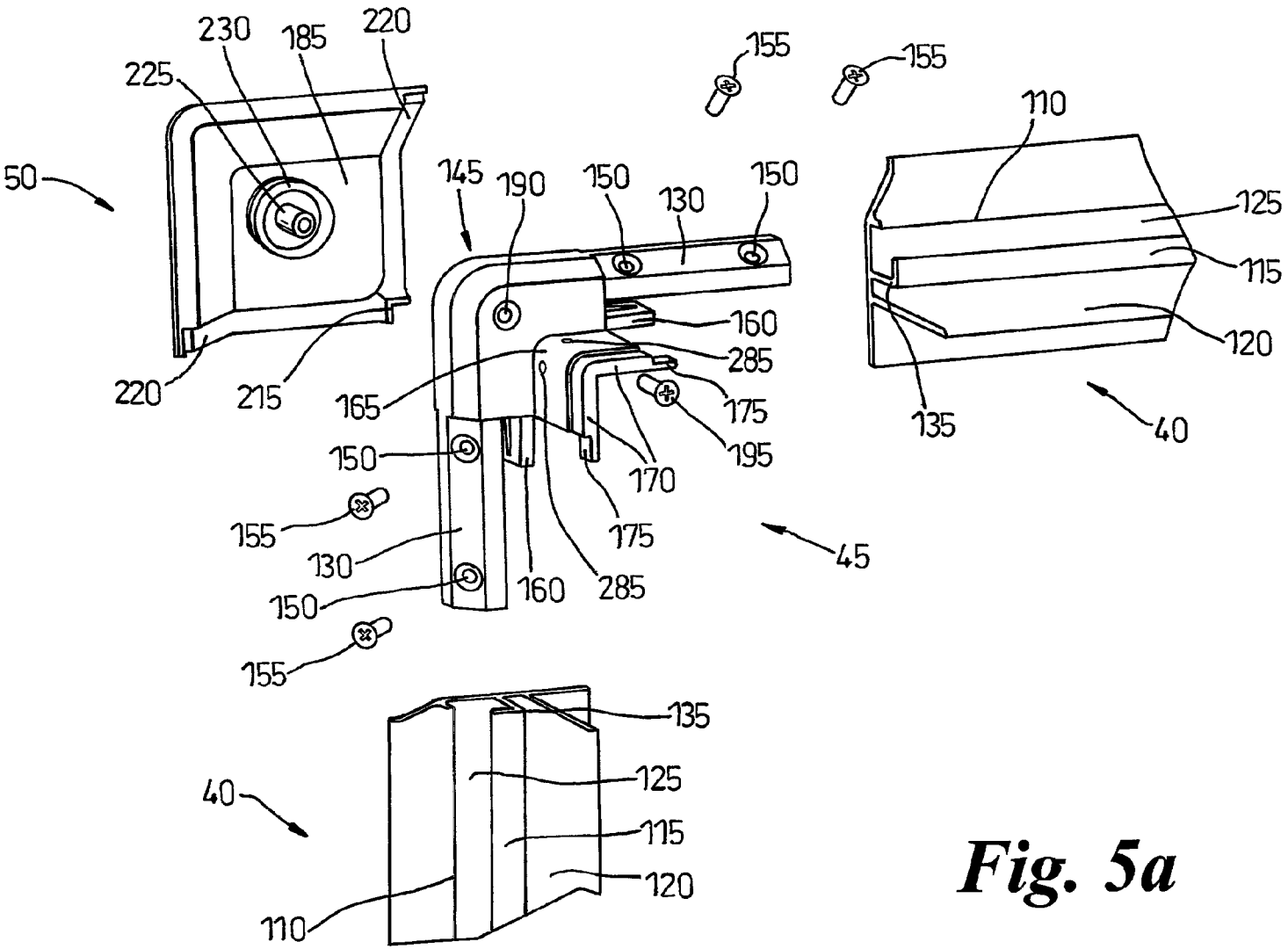
Figure 5B:
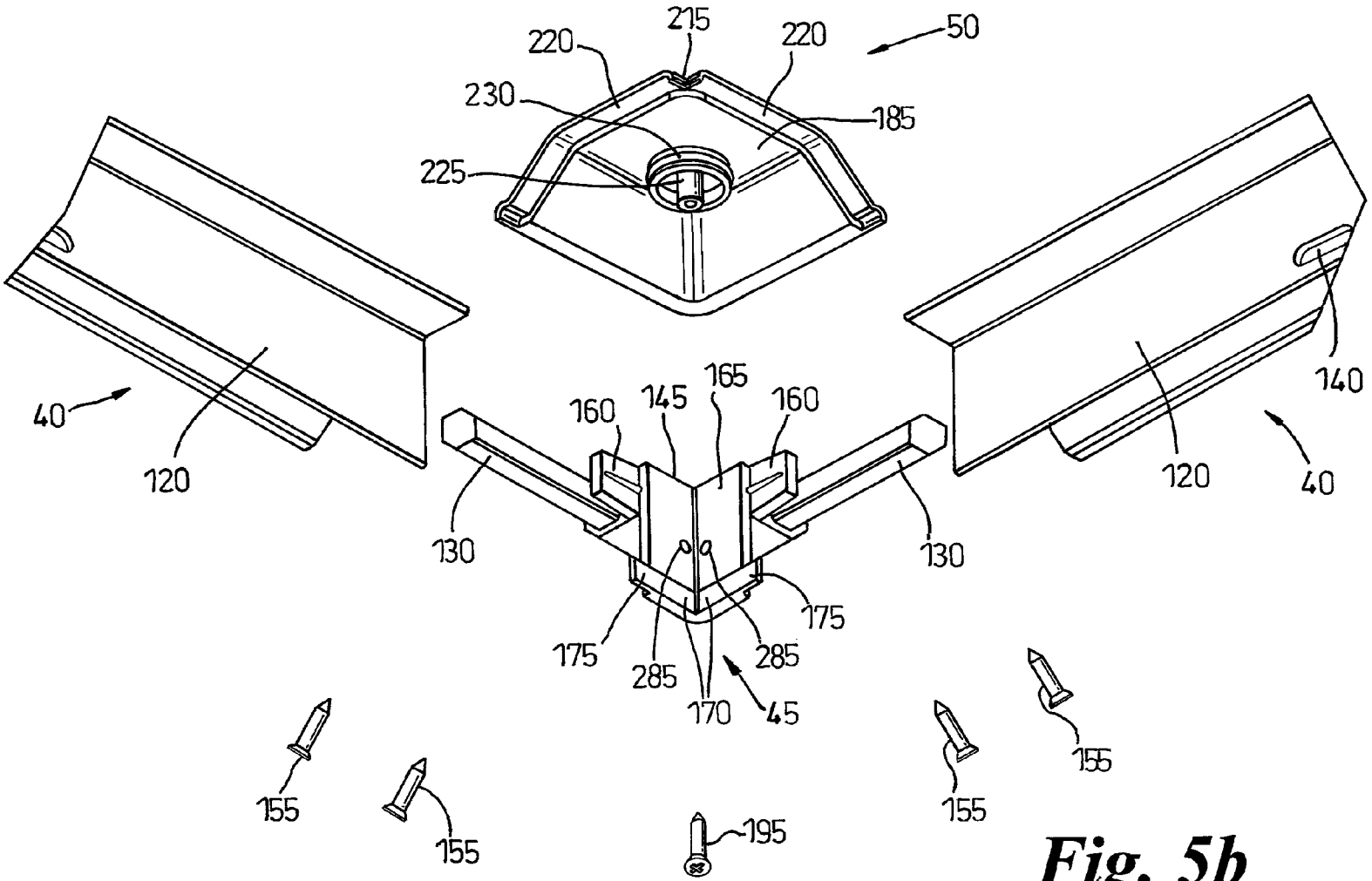
Figure 5C:
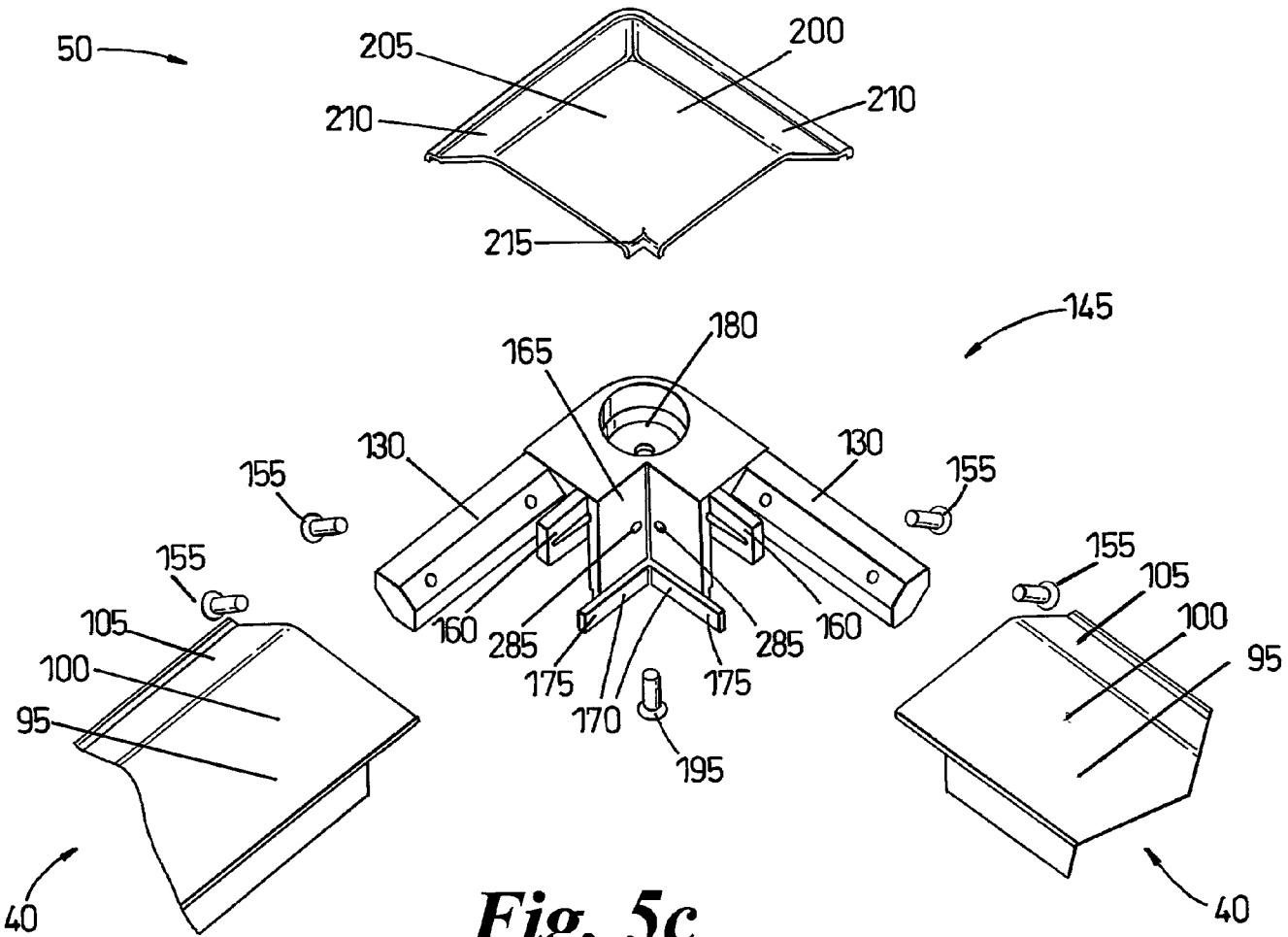
Figure 6A:
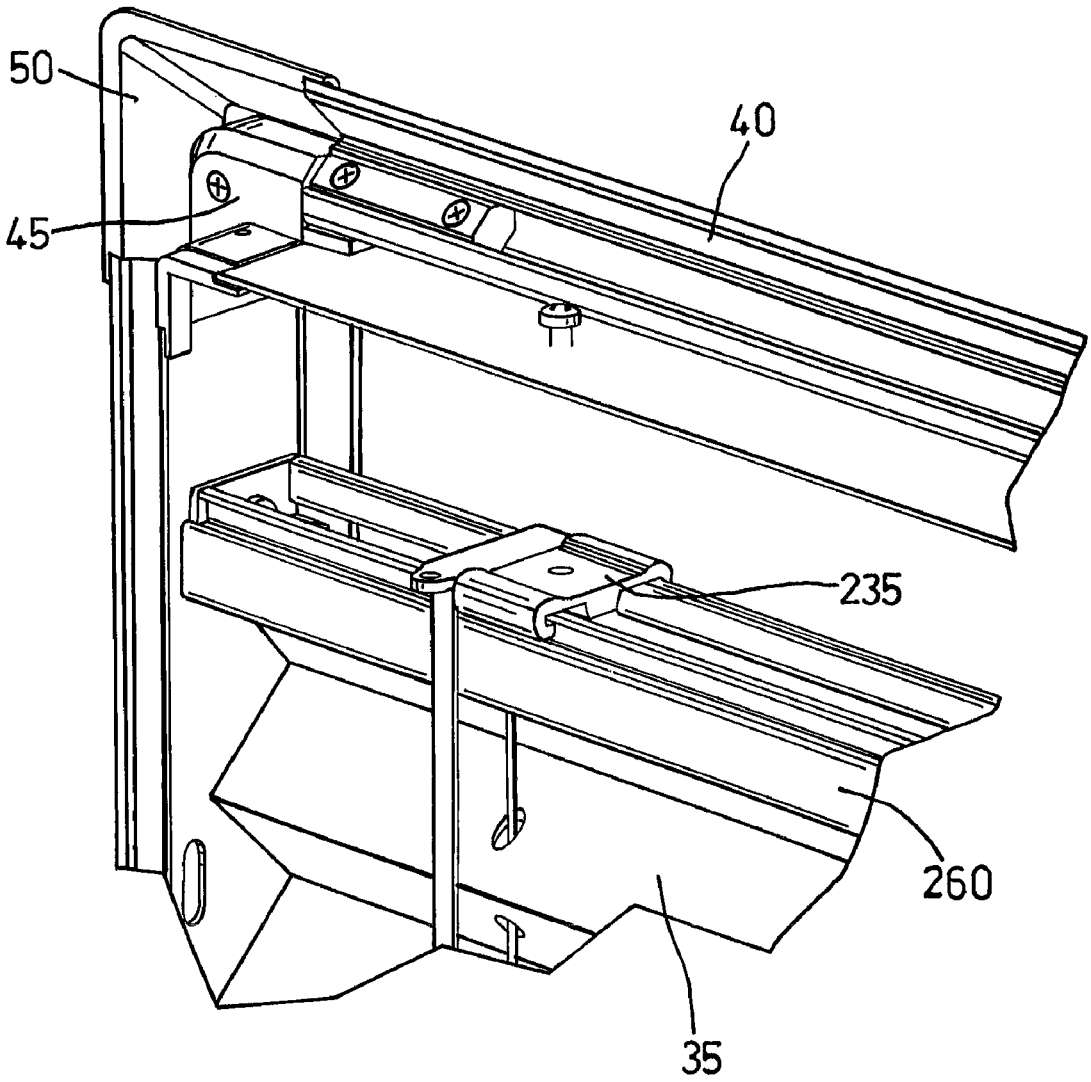
Figure 6B:
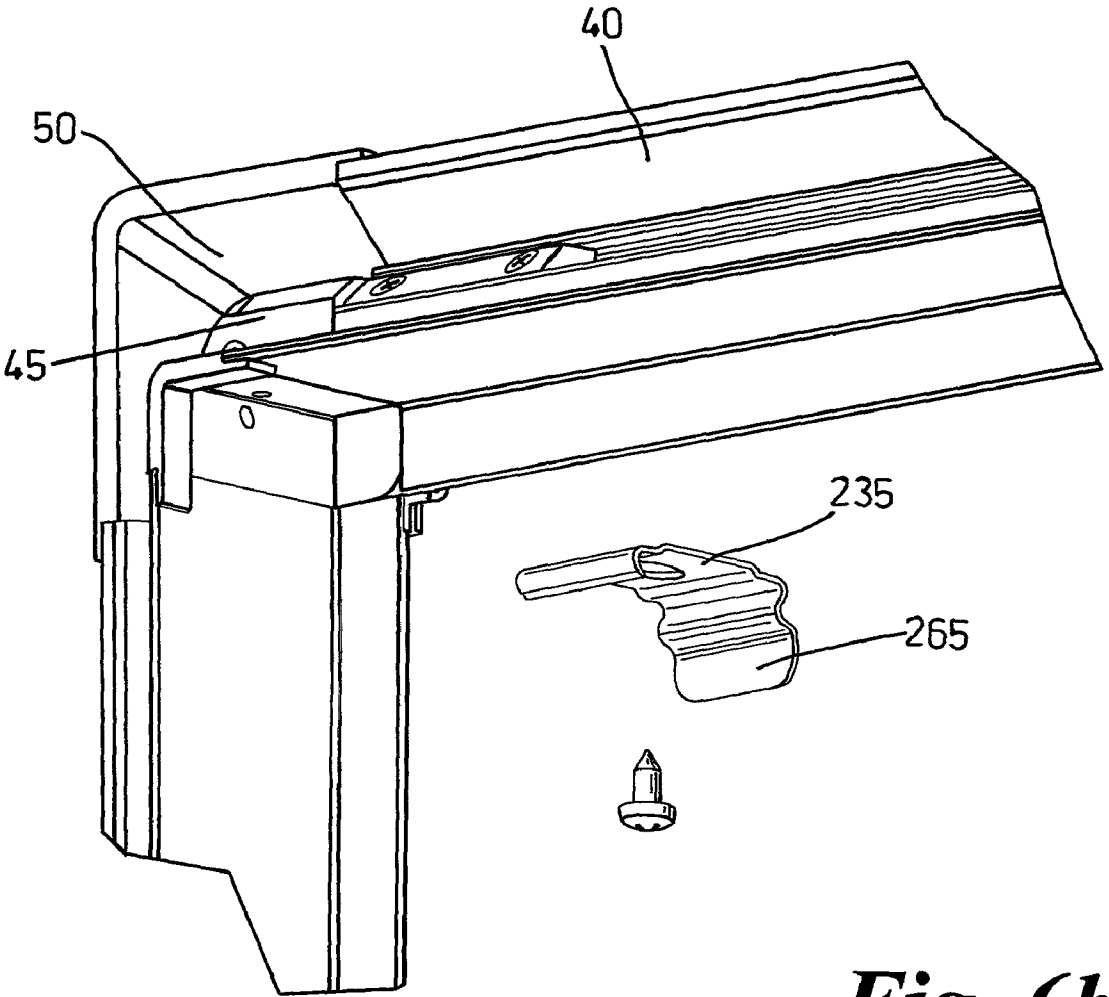
Figure 6C:
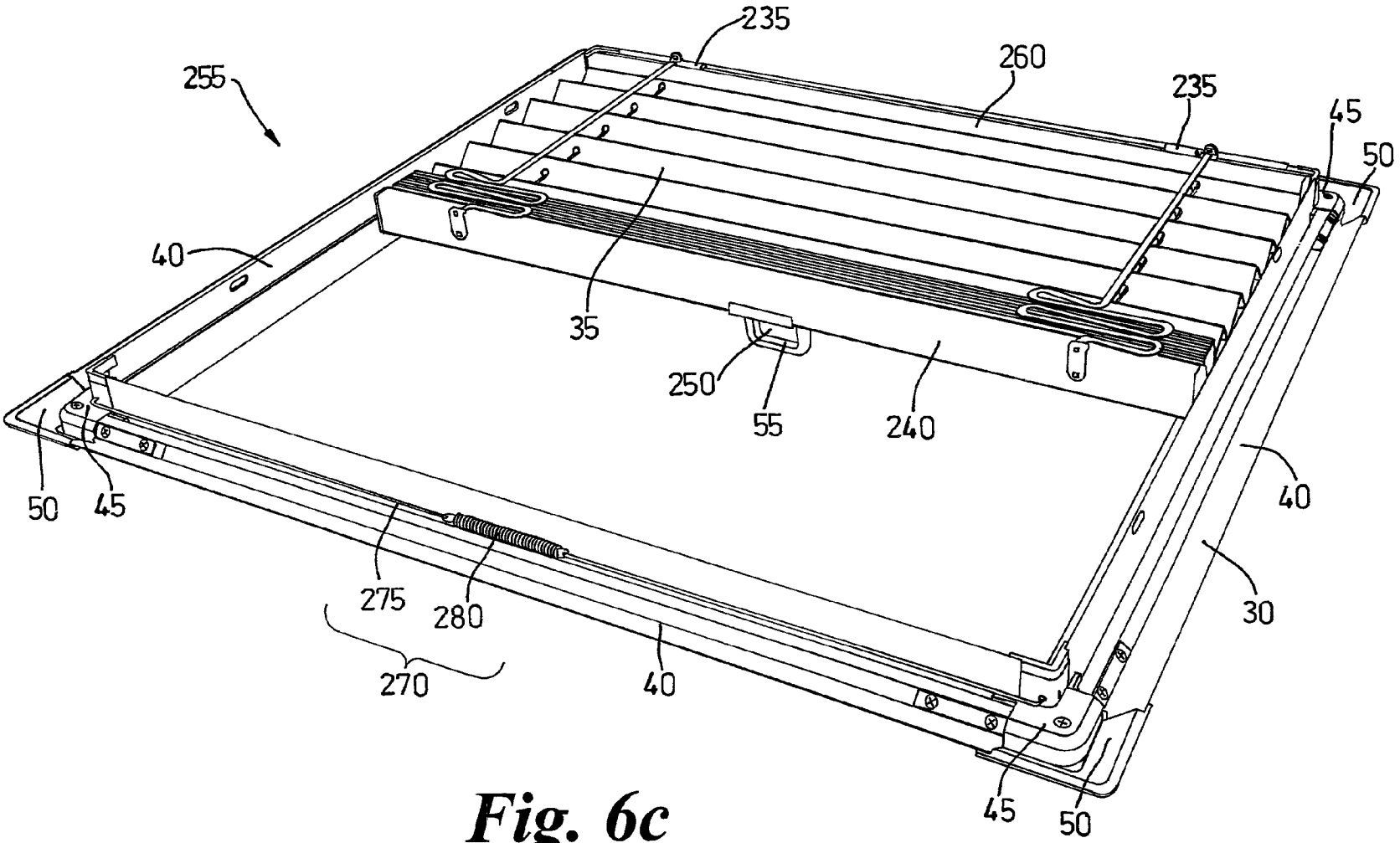
Figure 7:
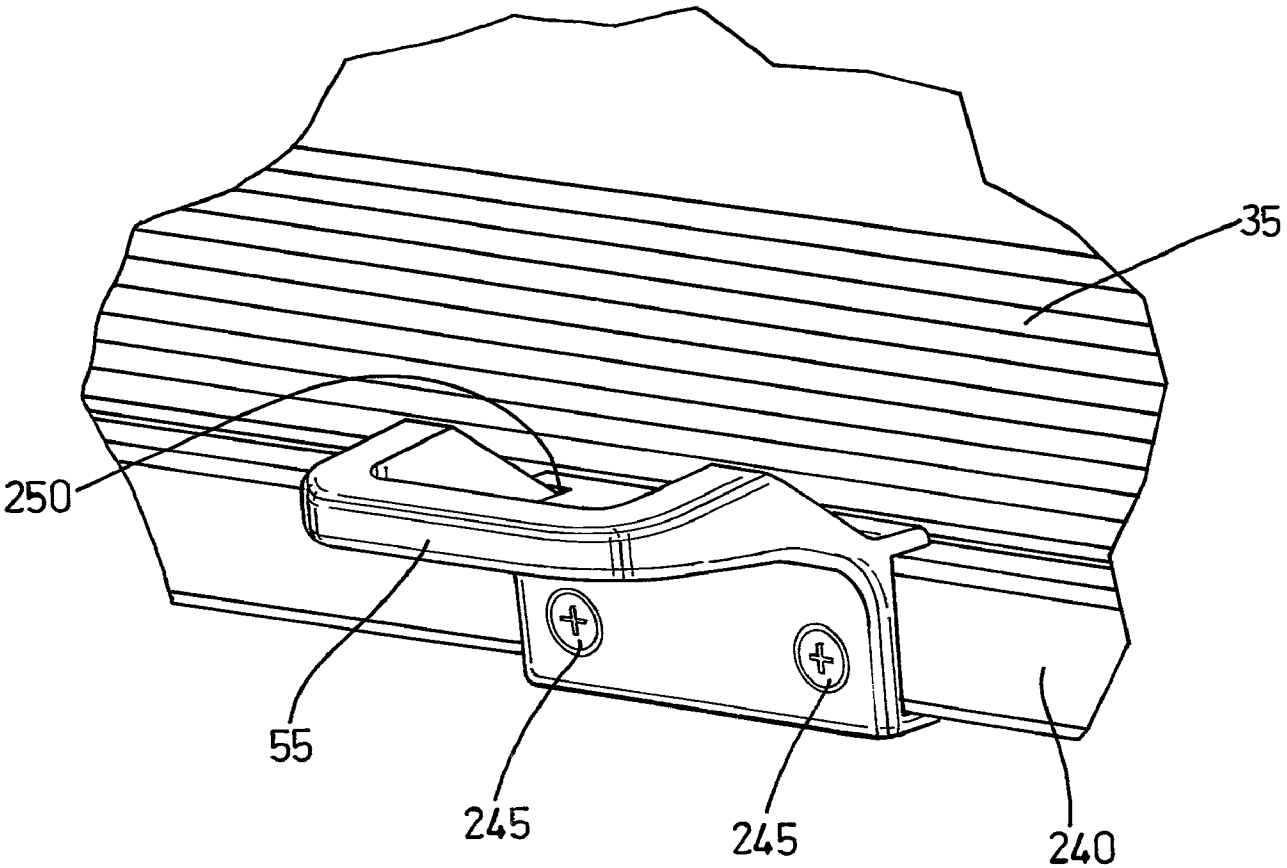
Figure 8A:
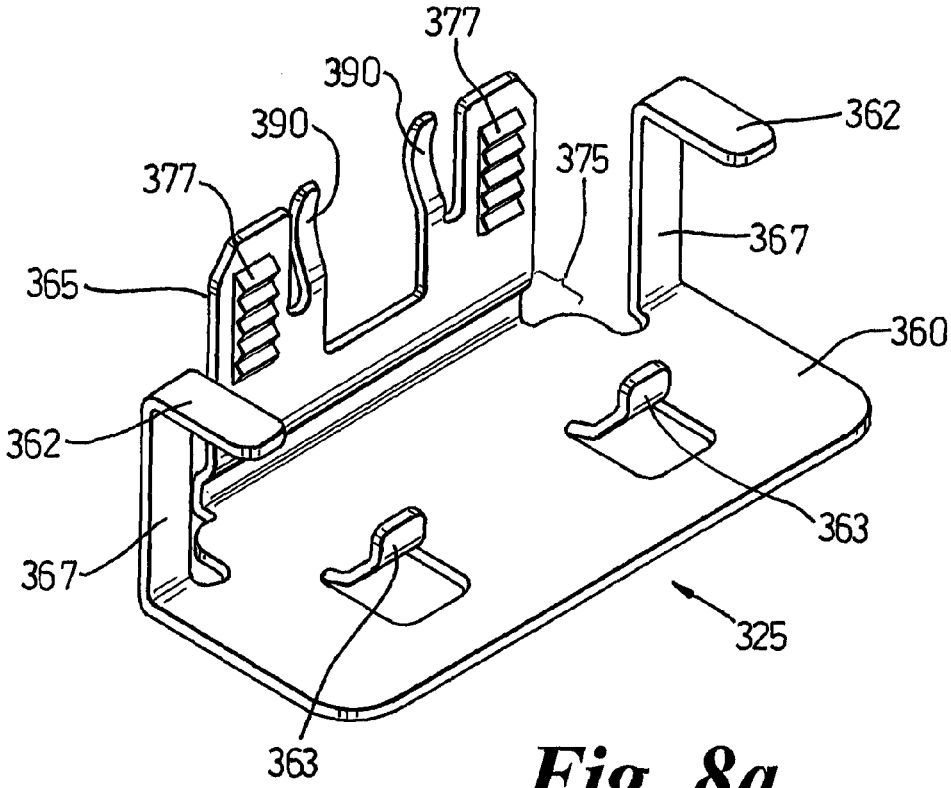
Figure 8B:
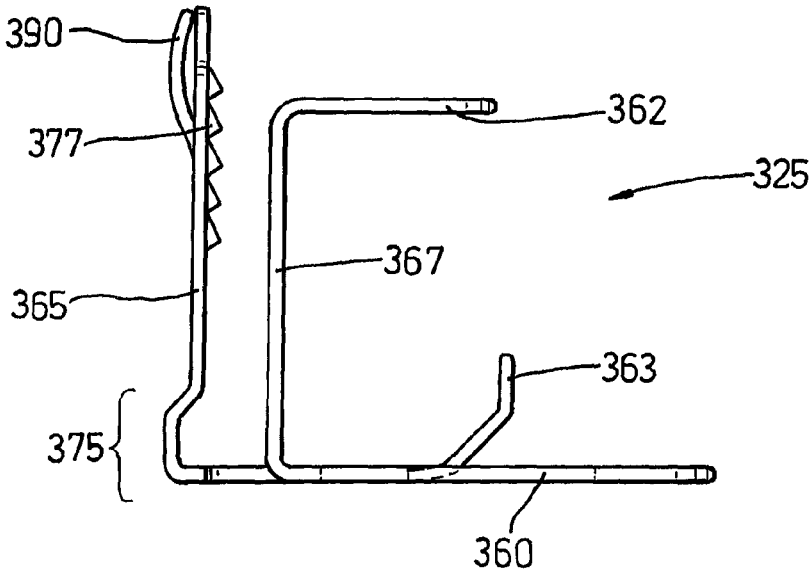

FIG. 4*a* is a diagrammatic profile view of the frame-securing clip and extruded portion of FIG. 3 prior to retention of the frame by the frame-securing clip;

FIG. 4*b* is a diagrammatic profile view of the frame-securing clip and extruded portion of FIG. 4*a* during retention of the frame by the frame-securing clip;

FIG. 5*a* is a perspective view of the components of the frame from below, behind and one side;

FIG. 5*b* is a perspective view of the components of the frame from below, in front and one side;

FIG. 5*c* is a perspective view of the components of the frame from above, in front and one side;

FIG. 6*a* is a partial perspective view of the window blind frame system of the invention from above, behind and one side;

FIG. 6*b* is a perspective view of the components of the window blind frame system from below, behind and one side;

FIG. 6*c* is a perspective view of the window blind frame system of FIG. 6*a* from above, behind and one side;

FIG. 7 is a perspective view of the handle which may be present on the blind of the third aspect of the invention;

FIG. 8*a* is a perspective view of a frame-securing clip of an alternative embodiment of the invention;

FIG. 8*b* is a diagrammatic profile view of the clip of FIG. 8*a;*

Figure 9A:
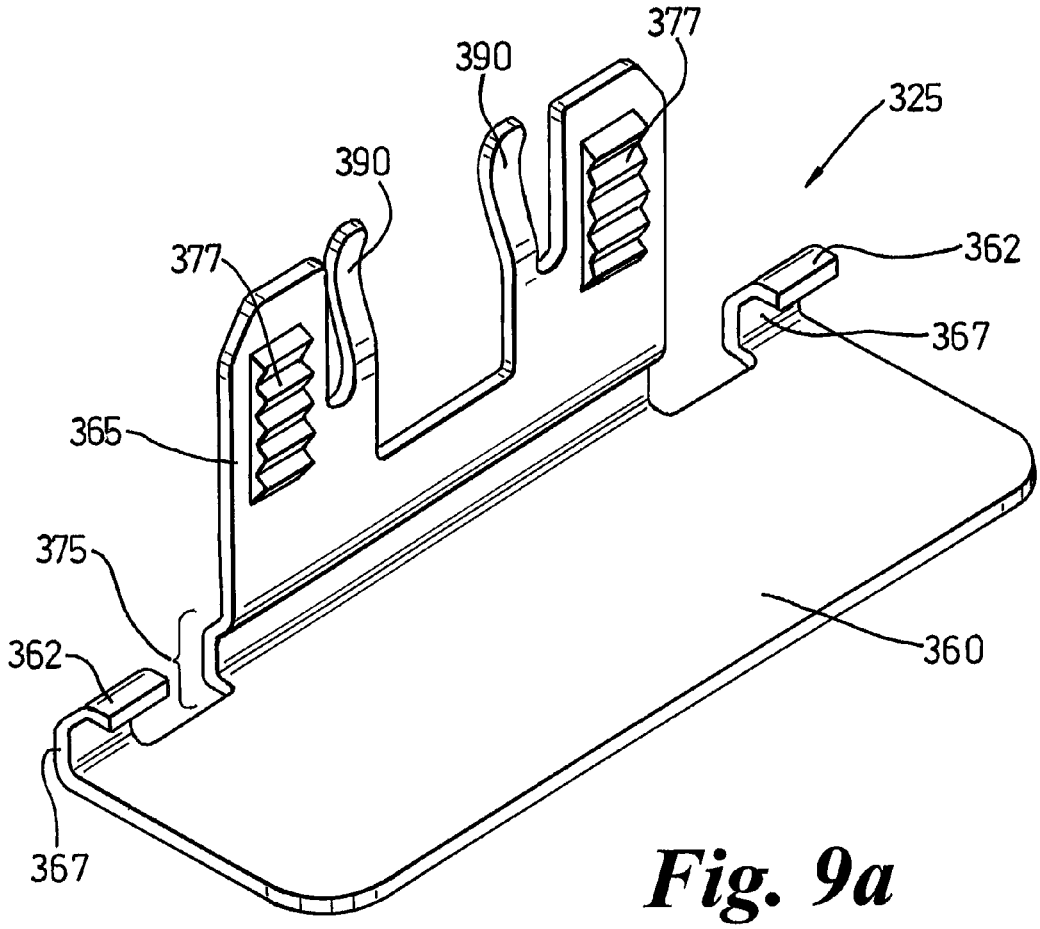
Figure 9B:
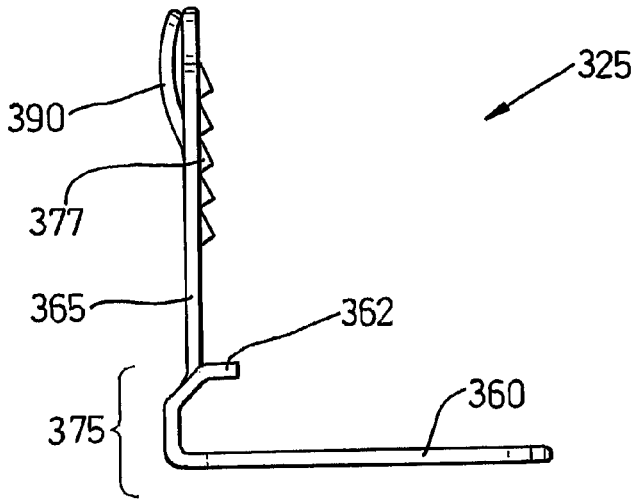

FIG. 9*a* is a perspective view of a frame-securing clip of an alternative design of the clip of FIG. 8;

FIG. 9*b* is a diagrammatic profile view of the clip of FIG. 9*a;*

Figure 10A:
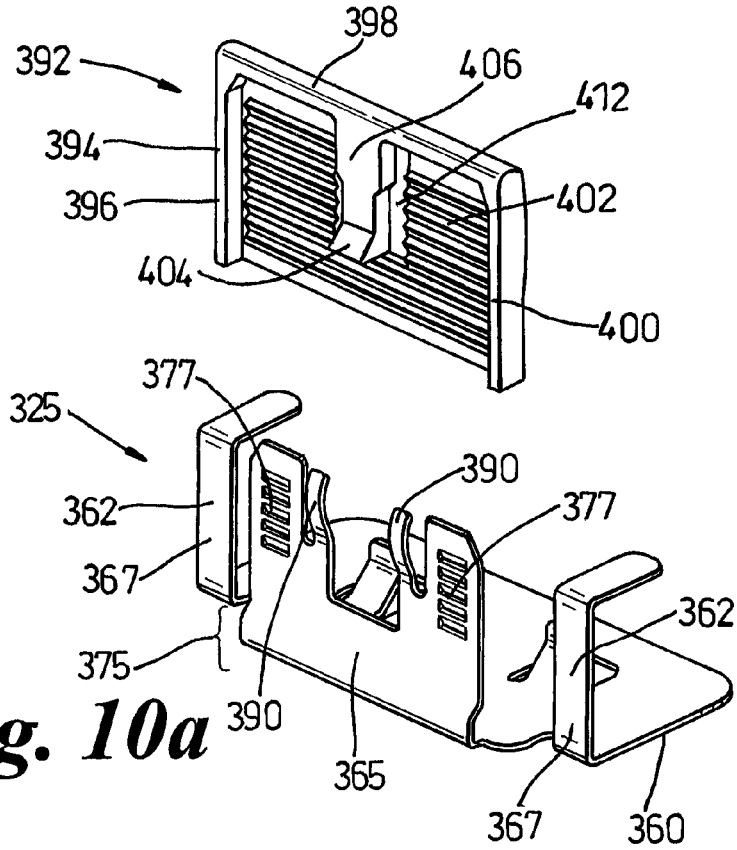
Figure 10B:
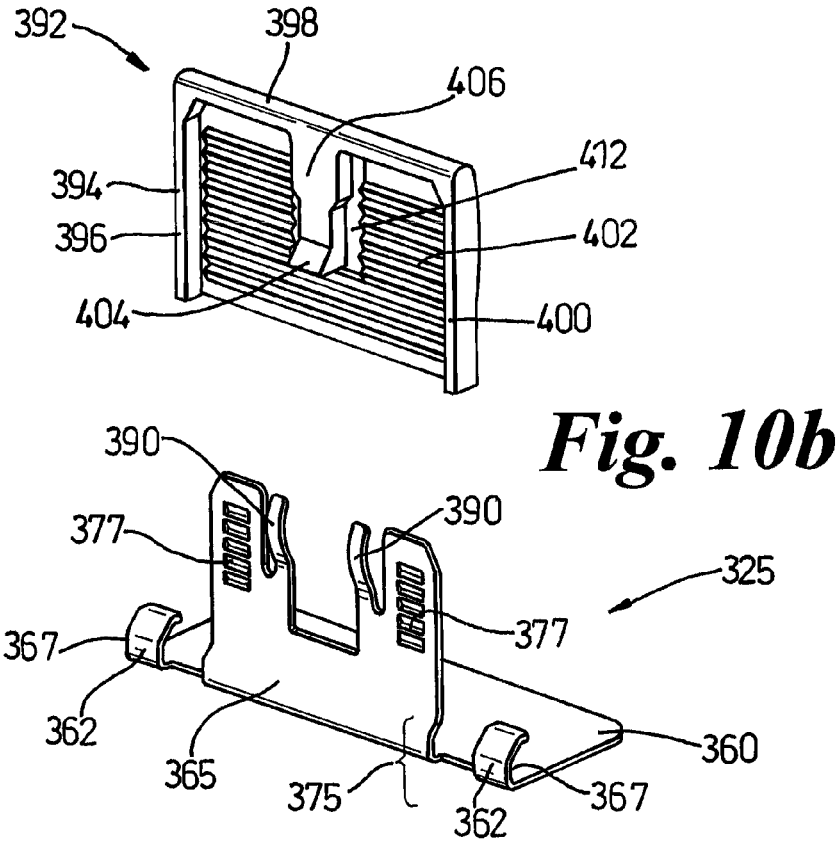

FIG. 10*a* is a perspective view of the interaction a positioning guide with the frame-securing clip of FIG. 8; and FIG. 10*b* is a perspective view of the interaction a positioning guide with the frame-securing clip of FIG. 9.

For the avoidance of doubt it should be noted that in this specification reference to 'up' and 'down', 'width', 'upper', 'lower', 'vertical', 'horizontal', 'front', 'back' and related terms refer to the orientation that the components of the blind adopt when installed for normal use, as they are shown in the Figures.

Figure 1:
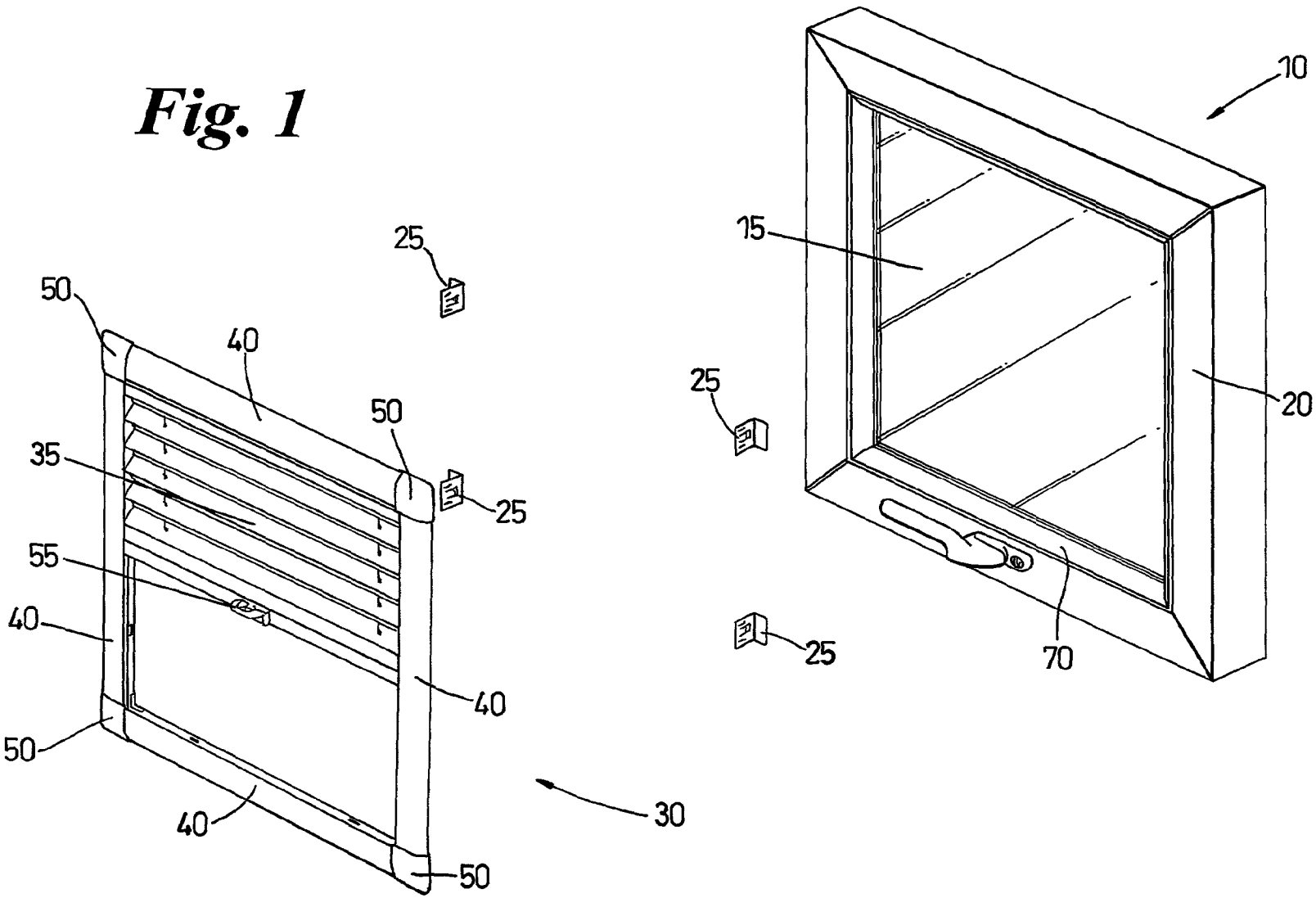
FIG. 1 is an expanded perspective view of the window blind frame system of the invention.
Figure 2:
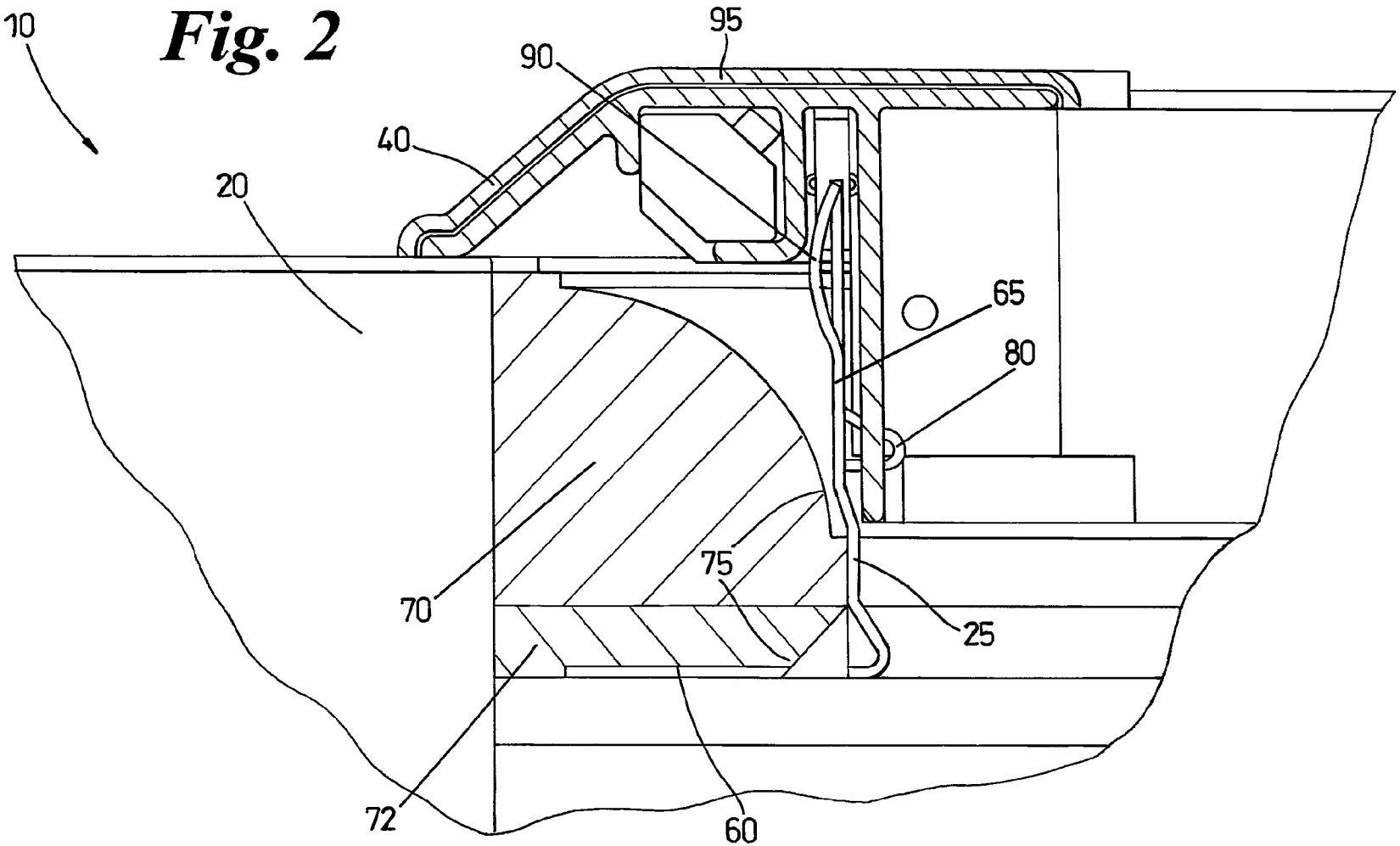
FIG. 2 is a cross-sectional view of the window blind frame system of FIG. 1 when fitted.

FIG. 1 shows a rectangular UPVC window 10 including a pane of glass 15 and a casing 20. Also shown are four frame-securing clips 25 and a frame 30 falling within the scope of the invention. FIG. 2 illustrates the interaction between the frame 30, the frame-securing clip 25 and the window casing 20 when the window blind frame system is fitted. The frame 30 of this embodiment of the invention includes four extruded portions 40 connected by four 90° angle joints 45 to form a stable rectangular frame 30. In this example, each angle joint 45 is hidden from view by a plastics cover 50. The frame 30 of the described embodiment includes a pleated blind 35 of a type well known in the art. This blind 35 includes a handle 55 positioned in the bottom centre of the blind 35 as positioned for use.

The frame-securing clip 25 of this embodiment of the invention, as illustrated in FIGS. 3, 4*a* and 4*b* is of one piece metallic construction and includes a flange 60 and a support 65 extending substantially orthogonally from the flange 60 to form a frame-securing clip 25 of generally 'L' shape. This is most clearly shown in FIGS. 4*a* and 4*b*. The flange 60 of this embodiment is of uniform planar shape with rounded corners to prevent damage to the beading 70 present in the window casing 20 during insertion, and in particular, to prevent damage to a resiliently deformable gasket 72 which present between the beading 70 and the glass pane 15 to prevent leakage of water through the window. In older windows 10, the resiliently deformable gasket 72 is a separate component, inserted between beading 70 and glass pane 15. However, newer windows typically incorporate the beading 70 and gasket 72 as one component wherein the beading 70 and the gasket 72 are bonded together. The resiliently deformable gasket 72 will typically be rubber or neoprene.

The flange 60 of the frame-securing clip 25 is preferably dimensioned so that flange 60 extends in use sufficiently far into the joint between the gasket 72 and glass pane 15 so as to provide secure retention, but not so far in as to be likely to damage the seal between the gasket 72 and glass pane 15.

An additional advantage of the rounded corners of the flange 60 is improved safety to the user, as the likelihood of sharp edges cutting the hands is reduced. In this embodiment the support 65 projects over the flange 60 and upwards. As the support 65 extends away from the point of connection with the flange 60, the support 65 is configured in two steps upwards and over the flange forming a corrugated section 75. The support 65 includes a resilient lug 80. The resilient lug 80 is formed by removing a U-shaped section of metal from the support and subsequent shaping of the remaining metallic projection to leave a resiliently deformable stem 85 ending in a lug 80. The lug 80 extends outwards from the support 65 in a direction away from the direction of projection of the flange 60.

In this example of the invention, the frame-securing clip 25 includes two arcuate prongs 90, formed from the support 65 on opposite edges of the support 65. The prongs 90 extend from the body of the support 65, to a point level with the upper edge of the support 65. The prongs 90 are formed by removing two portions of the support 65 and shaping the projections which remain on either edge of the support 65 into arcuate form. In this embodiment the arcs of the prongs 90 project over the flange 60 and away from the direction of projection of the resilient lug 80.

FIGS. 5*a*-5*c* show the components of the frame 30 of this embodiment of the invention. The frame 30 includes four extruded portions 40 of identical cross-section, joined by four angle joints 45. In this embodiment, the extruded portions 40 are metallic and painted. The cross-section of the extruded portions 40 is shown most clearly in FIGS. 4*a* and 4*b* and does not vary along the length of the extruded portion 40. The extruded portion 40 comprises a front face 95 moulded to provide an aesthetically pleasing integrated appearance with the window casing 20 when the frame 30 is fitted. In this embodiment the front face 95 includes a substantially flat region 100 towards what will become the inner edge of the frame 30 when assembled, and a pitched region 105, running away from the flat region 100 towards the window casing 20.

In this embodiment, extending orthogonally from the rear of the front face of the extruded portion 95 are three projections 110, 115, 120. Two of these projections 110, 115 form a channel 125 for interaction with an arm 130 of the angle joint 45.

The first projection 110, the retaining projection, extends from the rear of the front face 95 of the extruded portion at the point where the flat region 100 and the pitched regions 105 of the front face 95 meet. The second projection, the receiving projection 115, ends in a cornered portion 135 bent so that it is substantially lateral to the flat region 100 of the front face of the extruded portion 95 and directed towards the outer edge of the extruded portion 40 when assembled into the frame 30. These two projections 110, 115 in combination with the rear of the front face of the extruded portion 95 form a channel 125 for receiving an arm 130 of the angle joint 45.

The third projection, the elongate projection 120, extends orthogonally from the rear of the front face of the extruded portion 95 adjacent the receiving projection 115. The elongate projection 120 includes periodic co-operating slots 140, which in this embodiment are ovoid, for interaction with the resilient lug 80 of the frame-securing clip 25 described above. The distance between the elongate projection 120 and the receiving projection 115 is sufficient to receive the arcuate prongs 90 of the frame-securing clip 25 between these two projections 115, 120. However, the space between the projections 115, 120 must also be sufficiently narrow that when the resilient lug 80 is engaged with the co-operating slot 140, the arcuate prongs act to retain the frame-securing clip 25 in position relative to the extruded portion 40.

FIGS. 5*a*-5*c* illustrate the angle joint 45 for interaction with the extruded portions 40 of the present embodiment. The angle joint 45 includes a body 145 and two arms 130 and is formed from a rigid plastics material. The arms 130 of this example extend at 90° from each other away from the body 145 which forms a corner. In this embodiment, each arm 130 is 30 mm in length and of hexagonal cross-section wherein two opposite sides of the hexagon are of greater length than the remaining four sides. This cross-section is selected to provide an intimate fit with the channel 125 formed in the extruded portion 40. Each arm 130 includes two chamfered apertures 150 for receiving screws 155. The screws 155 are present to secure the arms 130 in position relative to the extruded portion 40.

The angle joint 45 also includes two fins 160, each extending away from the body 145 parallel to the direction of extension of the arms 130 to which they are adjacent. In this embodiment, the distance of extension of the fins 160 is approximately one quarter the distance of extension of the arms 120. The fins 160 are positioned on the inner edge of the angle joint 45 and are received by the extruded portion 40 in the narrow space between the receiving projection 115 and the elongate projection 120. The presence of the fins 160 helps to stabilise the interaction between the extruded portion 40 and the angle joint 45.

In addition to the fins 160, this embodiment also describes a stabilising extension 165 projecting from the body 145 of the angle joint 45 in a direction parallel with the elongate projection 120 of the extruded portion 40 when the angle joint 45 and the extruded portion 40 are assembled for use. The distance of extension is substantially the same as the distance of extension of the elongate projection 120 of the extruded portion 40. The stabilising extension 165 comprises two parts 170 forming a corner. The edge of each part 170 abuts an end of an extruded portion 40 to which the angle joint 45 is connected. To further stabilise the connection between the angle joint 45 and the extruded portions 40, each abutting edge of the stabilising extension of this example includes a small tab 175 at the point farthest from the body 145 of the angle joint 45 which extends in a direction parallel to the direction of the arms 130. Each tab 175 lies on the inside of the elongate projection 120 when the extruded portion 40 and the angle joint 45 are connected, Accordingly, the elongate projection 120 lies between a tab 176 and a fin 160.

In this embodiment, the angle joint 45 further includes a circular cavity 180 for receiving locating means 185 from the cover 50. The cavity 180 is positioned in the body 145 of the angle joint 45, on the outer side of the joint 45 as positioned in use. There is a small hole 190 in the bottom centre of the cavity 180 through which a screw 195 may be screwed to secure the cover 50 to the angle joint 45.

In this embodiment the frame 30 additionally comprises a plastics cover 50 (FIGS. 5*a*-5*c*) to hide the angle joint 45 when the frame 30 is in use. The cover 50 is moulded to co-ordinate with the front face 95 of the extruded portion 40 and, in this embodiment, to cover a 90° angled joint 45. Accordingly, the cover 50 is substantially square and includes on an external surface 200 a roughly square flat region 205 towards what will become the inner edge of the frame 30 when assembled, and a pitched region 210 running away from the flat region 205 around outer two edges of the cover 50. The flat and pitched regions 205, 210 of the cover are configured to co-operate with the flat and pitched regions 100, 105 of the front face 95 of the extruded portion 40. The dimensions of each edge of the cover 50 are slightly greater than the width of the extruded portions 40, allowing overlapping coverage of the angle joint 45. Accordingly, the innermost corner of the cover 50 includes an indent 215 so that a sharp corner is observed on the inner edge of the frame 30 when assembled for use.

The internal surface of the cover 50 includes flanges 220 along the two edges of the cover 50 which will abut the front face 95 of an extruded portion 40. These flanges 220 overlap with the extruded portions 40 and ensure that the ends of the extruded portions 40 are completely covered. In addition, the cover 50 of this embodiment includes locating means 185. In this embodiment they comprise a securing lug 225 adapted to receive a screw 195, and a collar 230 surrounding the securing lug 225 and adapted to co-operate with the circular cavity 180 of the angle joint 45, thereby holding the cover 50 securely in position relative to the angle joint 45 and extruded portions 40.

The frame 30 of this embodiment houses a 20 mm pleated window blind 35 as is known in the art. The blind 35 is releasably secured to the frame 30 using spring clips 235 of a size suitable for receiving a head rail 260 of blind 35 (FIGS. 6*a* and 6*b*). Two spring clips 235 are present, one each attached, using a screw fitting, to the top edge of the frame 30 when positioned for use. The blind 35 engages with the spring clip 235 through a snap fit interaction and is easily released from the spring clip 235 by flexing a ledge 265 of the spring clip 235 to release the pressure holding the head rail 260 in position.

The blind 35 is maintained in the desired deployment position by means of a tensioning cord 270 which is shown in FIG. 6*c*. The tensioning cord 270 comprises a cord element 275 and a tension spring 280. A first end of the cord element 275 is attached to a first end of the tension spring 280, which is positioned behind an extruded portion 40 of the frame 30 and arranged such that it threads from the tension spring 280 along the extruded portion 40 from right to left. It then passes through a hole 285 in the stabilising extension 165 of the angle joint 45 and through a sliding rail 240 from left to right. The sliding rail 240 is positioned at the moving edge of the blind 35. The tension spring 280 is then passed through the head rail 260 from right to left. A figure of eight configuration is formed by further threading the cord element 275 back through the sliding rail 240, again from left to right, and then back to the tension spring 280, passing through a hole 285 in a stabilising extension 165 of a second angle joint 45 entering from the right side and connecting to a second end of the tension spring 280. This provides effectively a continuous loop of the tensioning cord 270 which is under tension and provides the sliding rail 240 with a frictional resistive force against its movement. The amount of resistance to movement can be varied by verifying the tensile force of the tension spring 280 or by varying the length of the tensioning cord 270.

The blind 35 in this embodiment is of a size such that the edges of the blind 35 are not visible when the blind 35 is housed in the frame 30.

In this embodiment of the invention, the blind 35 also includes a handle 55. The handle 55, shown in FIG. 7, is of plastics material and is positioned at the bottom of the blind 35 as fitted for use. The handle 55 is affixed to the sliding rail 240 of the blind 55 using two screw fastenings 245. The handle 55 protrudes from the blind 35 substantially at right angles from the blind 35, and is curved upwards to allow the blind 35 to deploy fully so that the aperture created by the frame 30 is entirely covered. In this embodiment the handle 55 includes a substantially central aperture 250 to facilitate manipulation of the blind 35.

The different components of the window blind frame system generally designated 255, interact as illustrated in FIGS. 2, 4*b* and 5*a-c*. In this embodiment, the assembly of the frame 30 is achieved by taking four pre-cut extruded portions 40 as described above and connecting these to four angle joints 45 so that a rectangular frame 30 is formed. The extruded portions 40 correspond to the dimensions of the window casing 20 into which the frame 30 will be fitted. Connection of each angle joint 45 to an extruded portion 40 is effected by sliding an arm 130 of the angle joint 45 into the reciprocating channel 125 in the extruded portion 140. The arm 130 is then secured in position using two screws 155. This is repeated for the second arm 130 of the angle joint 45 with a second extruded portion 40 and continued until all joints 45 and extruded portions 40 are connected.

In this embodiment, once the rectangular frame 30 has been assembled, a cover 50 is affixed to each corner of the frame 30 by locating each cover 50 relative to each angle joint 45 using the collar 230 of the cover 50 and the circular cavity 180 of the angle joint 45. The cover 50 is held in position relative to the angle joint 45 using a screw fixing 195.

The blind 35 is then fitted to the frame 30 by snap-fit interaction with spring clips 235. This is followed by threading a first end of the cord element 275 of the tensioning cord 270 through a first hole 285 in a stabilising extension 165 of a first angle joint 45; threading a second end of the cord element 275 of the tensioning cord 270 through a second hole 285 in a stabilising extension 165 of a second angle joint 45; and connecting the cord element 275 to both ends of tension spring 280.

Once the frame 30 is assembled, and a blind 35 attached to the frame 30, the window blind frame system 255 may be fitted into a window 10. In this example, fitting is achieved by placing four frame-securing clips 25 as described above in position in the window casing 20. The frame-securing clips 25 are evenly spaced, two each interacting with each of two longest extruded portions 40 of the frame 30. In this embodiment the longest extruded portions 40 form each of the two substantially 'upright' sides of the window casing 20 as shown in FIG. 1. Interaction is achieved, as illustrated in FIG. 2, by sliding the flange 60 of the frame-securing clip 25 under the beading 70 of the window casing 20, between the beading 70 and the window pane 15.

The frame 30 is then fitted to the window 10 via the frame-securing clips 25. Specifically, the resilient lug 80 of the frame-securing clip 25 interacts with a co-operating slot 140 in the extruded portion 40 of the frame 30 and is retained in the co-operating slot 140 by the presence of the arcuate prongs 90. The arcuate prongs 90 extend from the support 65 so that the outer surface of the arcuate prong 90 projects over the flange 60 and away from the resilient lug 80. This facilitates retention of the resilient lug 80 with the co-operating slot 140 by a snap-fit interaction facilitated by urging the arcuate prong 90 past the receiving projection 115 of the extruded portion 40 of the frame 30 , thereby allowing the resilient lug 80 to enter the co-operating slot 140. Accordingly, the frame 30 is retained in close contact with the window casing 20 to provide an integrated appearance.

If removal of the frame 30 from the window 10 is required, the resilient lug 80 may be pushed back through the co-operating slot 140 in the frame 30, releasing the frame 30 and facilitating removal.

FIGS. 8*a*, 8*b*, 9*a* and 9*b* illustrate two clips 325 of an alternative embodiment of the invention. The frame-securing clip 325 of this embodiment is of one piece metallic construction and includes a flange 360 and a support 365 extending substantially orthogonally from the flange 360 to form a frame-securing clip 325 of generally 'L' shape. The flange 360 of this embodiment is similar to the flange 60 of the frame-securing clip 25 of the first embodiment of the invention. Specifically, the flange 360 is of uniform planar shape with rounded corners to prevent damage to the beading 70 present in the window casing 20 during insertion. The rounded corners help to prevent damage to a resiliently deformable gasket 72 which present between the beading 70 and the glass pane 15 to prevent leakage of water through the window. The resiliently deformable gasket 72 will typically be rubber or neoprene.

The flange 360 of the frame-securing clip 325 is preferably dimensioned so that flange 360 extends in use sufficiently far into the joint between the gasket 72 and glass pane 15 so as to provide secure retention, but not so far in as to be likely to damage the seal between the gasket 72 and glass pane 15. Damage to the seal may also be prevented using spacers 362 or stop juts 363 which can limit the distance of ingress under the gasket 72 of flange 360. An additional advantage of the rounded corners of the flange 360 is improved safety to the user, as the likelihood of sharp edges cutting the hands is reduced.

The flange 360 of this embodiment includes two spacers 362 to support the extrusion 40 one each extending from the two edges of the flange 360 adjacent to the support 365. In the embodiment of FIGS. 8*a* and 8*b* each spacer 362 comprises a stem 367 formed upwards orthogonally from the flange 360 is then formed back at right angles so that this portion of the stem 367 extends substantially parallel to the flange 360 in a direction away from the support 365. These spacers 362 function to support the extruded portion 40 of the frame 30 as the portion of the stem 367 formed at right angles hooks under a projection from an extruded portion 40 of the frame 30, aiding retention of the extrusion 40 in position relative to the clip 325 and window casing 20.

In the embodiment of FIGS. 9*a* and 9*b*, each spacer 362 comprises a short stem 367 extending from the support 365 edge of the flange 360. The stem 367 extends upwards orthogonally to the flange 360 before bending back over the flange 360 to form a U-shaped configuration at this edge of the flange 360. The spacer 362 of this embodiment is functioning to prevent damage to the seal between the glass pane 15 and window casing 20 by preventing the clip 325 from being inserted into the space between the glass pane 15 and rubber gasket 72 which is typically present in modem window and door casings 15 beyond the distance necessary for secure retention of the clip 325. If the flange 360 is inserted too far into the space between the window casing 20 and the glass pane 15, the seal between the rubber gasket 72 and glass 15 may be broken allowing water to flow through the window casing 20.

In FIGS. 8*a* and 8*b*, this function is fulfilled by two stop juts 363 which are formed from the planar surface of the flange 360 and bent upwards at approximately 45° to the surface of the flange 360 so that the juts 363 project towards the edge of the flange 360 away from the support 365. The end of the juts 363 is bent upwards orthogonally from the flange 360 to form a barrier to the further insertion of the flange 360 into the window casing 20. This barrier abuts the window casing 20 in use. In the embodiment of FIGS. 8*a* and 8*b*, there are two stop juts 363, positioned in from the edges of the flange 360 at a position substantially parallel to the engaging members 377 of the support 365.

The tips of the spacers of the clips of FIGS. 8*a*, 8*b*, 9*a* and 9*b* have rounded corners to reduce the risk of damage to the user or window casing 20 with which the clips 325 are used.

In the embodiment of FIGS. 8*a*, 8*b*, 9*a* and 9*b*, the support 365 projects over the flange 360 and upwards. As the support 365 extends away from the point of connection with the flange 360, the support 365 is configured in two steps upwards and over the flange forming an indented section 375.

The support 365 of this embodiment does not extend across the entire width of the flange 360 but extends orthogonal to the flange 360 for approximately the central ⅔ of the width of the flange 360. The connection of the support 365 of the clip 325 of FIGS. 8*a*, 8*b*, 9*a* and 9*b* is narrowed and extends across approximately the central ½ of the width of the flange 360. Above the indented section 375 the width of the support 365 expands to approximately ⅔ the width of the flange 360. There are two rectangular serrated regions 377 on the clip, one each at the two shorter edges of the support. In the embodiment of FIGS. 8*a*, 8*b*, 9*a* and 9*b*, the frame-securing clip 325 includes two arcuate prongs 390, formed from the support 365 and positioned towards the middle of the longer edge of the support 365 adjacent to the serrated regions 377. The prongs 390 extend from the body of the support 365, to a point level with the upper edge of the support 365. The prongs 390 are formed by removing two portions of the support 365 and shaping the projections which remain on either edge of the support 365 into arcuate form.

In the embodiment of FIGS. 8*a*, 8*b*, 9*a* and 9*b* the arcs of the prongs 390 project away from the flange 360 and away from the direction of projection of the serrations of the serrated regions 377.

The frame-securing clips 325 of FIGS. 8*a*, 8*b*, 9*a* and 9*b* are designed engage a positioning guide 392 (shown in FIGS. 10*a* and 10*b*) which in this example is rectangular and of dimensions 43 mm×26 mm×4 mm. In this embodiment there is a continuous raised edge 394 along a first short side 396 of the positioning guide 392, a first long side 398 of the positioning guide 392 and a second short side 400 of the positioning guide 392. The side of the positioning guide 392 from which the raised edge 394 extends is covered with elongate serrations 402 for engaging the co-operating serrated regions 377 on the clips 325 of FIGS. 8*a*, 8*b*, 9*a* and 9*b*. In this embodiment the serrations 402 are approximately 1 mm deep. Thus, it is possible for the clips 325 and the positioning guide 392 to adopt and be retained in a range of different relative positions.

In the example of FIGS. 10*a* and 10*b*, the positioning guide 392 is of one-piece moulded plastic. In this embodiment, the positioning guide 392 is retained in position relative to an extruded portion of the frame 30 by the inclusion of a resilient lug 404 on a stem 406, the stem 406 extending from the middle of the first long side 398 of the positioning guide from the raised edge 394. The direction of extension in this example is parallel to the plane of the positioning guide 392 which includes the serrations 402. The lug 404 is at the end of the stem 406 distal to the raised edge 394 and protrudes in a direction away from the serrations 402.

Deformation of the lug into the plane of the positioning guide 392 including serrations 402 is facilitated by the presence of an elongate aperture 412 formed from the serrated region 402 of the positioning guide 392 adjacent to the lug 404 and stem 406. This aperture 412 allows the lug 404 to be temporarily deformed inwards when the clip 325 and positioning guide 392 combination are placed in position relative to an extruded portion 40 of the frame 30. Once positioned, the lug 404 can return to an undeformed position and engage with a co-operating slot 140 in the frame 30.

It will be apparent to those skilled in the art that various modifications could be made to the specific embodiment described above within the scope of the present invention as defined in the appended claims.

What is claimed is:

1. A frame system for securing a window blind to a window, said frame system comprising a frame having at least two angle joints connecting at least three extruded portions to form a substantially rigid structure; and a frame-securing clip comprising a flange and a support extending substantially orthogonally from the flange generally along a support plane, wherein the flange is arranged for releasable retention between a beading and/or gasket and a glass pane of the window, and the support includes at least one engaging member extending out of the support plane, the engaging member being configured to releasably engage a cooperating receptacle in the frame, wherein the frame-securing clip is capable of releasably securing the frame to the window.

2. A frame system according to claim 1 wherein the engaging member includes at least one portion for adjustably securing the frame to the window.

3. A frame system according to claim 1, including three angle joints.

4. A frame system according to claim 1, including four angle joints connecting four extruded portions.

5. A frame system according to claim 1 wherein each angle joint includes first and second arms extending from a body of the angle joint to form an angle therebetween in the range 10°-170°.

6. A frame system according to claim 1, including covers secured to respective ones of the angle joints.

7. A frame system according to claim 6 wherein the covers are made from a plastics or die cast material.

8. A frame system according to claim 1, including a blind secured to the frame.

9. A frame system according to claim 8 wherein the blind is releasably secured to the frame with frame-securing clips or screws.

10. A frame system according to claim 8 wherein the blind is a pleated, roller or Venetian blind.

11. A frame system according to claim 8 wherein the blind is contained entirely within an opening defined by the frame.

12. A frame system according to claim 8 wherein the blind includes a handle.

13. A frame system according to claim 12 wherein the handle is at a moving edge of the blind.

14. A frame system according to claim 12 wherein the handle is shaped to allow extension of the blind throughout the opening of the frame.

15. A kit for making a window blind frame system comprising:

a frame-securing clip for securing a window blind frame to a window casing, the window blind frame having first and second projections, said frame-securing clip having a flange and a support extending substantially orthogonally from the flange generally along a support frame for retaining interaction between the first and second projections of the frame, wherein the flange is arranged for releasable retention between the window casing and a pane of a window, and wherein the support includes at least one engaging member configured to releasably engage a cooperating receptacle in the window blind frame;

at least three extruded portions; and at least two angle joints configured to be received by a respective channel in an extruded portion.

16. A kit according to claim 15, including additionally comprising a cover securable to a respective one of the angle joints.

17. A kit according to claim 15, including a positioning guide for adjustably securing the frame relative to the window casing.

18. A kit according to claim 15, including a blind.

19. A kit according to claim 18, including means for securing the blind to the frame.

20. A method of securing a window blind frame to a window casing using at least one window blind frame securing clip, the clip comprising a flange adapted to be located between the window casing and a glass pane located within the window casing, and a support extending substantially orthogonally from the flange, the support including at least one engaging member adapted to releasably engage the window blind frame;

characterised in that the method comprises inserting the flange of the clip between a beading and/or gasket of the window casing and the glass pane and engaging the window blind frame with at least one engaging member.

21. The method according to claim 20, characterised in that the clip is generally L-shaped.

22. The method according to claim 20, characterised in that the at least one engaging member is configured to interact with an extruded portion of the window blind frame.

23. The method according to claim 20, characterised in that the engaging member is a resilient lug extending from the support.

24. The method according to claim 23, characterised in that the lug extends in a direction substantially orthogonal to the support.

25. The method according to claim 20, characterised in that the support is planar and the at least one engaging member extends outwardly from the support plane.

26. A window casing including a window blind frame secured thereto, wherein the window blind frame is secured to the window casing by one or more window blind frame securing clips, characterised in that the clip comprising a flange releasably inserted between a beading and/or gasket of the window casing and a glass pane located within the window casing, and a support extending from the flange, the support including at least one engaging member releasably engaged with the window blind frame.

27. A window casing according to claim 26, characterised in that the window blind frame includes a window blind secured thereto.

28. A window casing according to claim 26, characterised in that the at least one engaging member interacts with an extruded portion of the window blind frame.

* * * * *